US006530257B2

(12) United States Patent
Ooji et al.

(10) Patent No.: US 6,530,257 B2
(45) Date of Patent: Mar. 11, 2003

(54) TERMINAL-CRIMPING DEVICE

(75) Inventors: Takahiro Ooji, Yokkaichi (JP); Youji Nishiki, Yokkaichi (JP); Yoshinori Suzuki, Sagamihara (JP); Kaoru Tadaki, Sagamihara (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/827,924

(22) Filed: Apr. 9, 2001

(65) Prior Publication Data

US 2001/0035039 A1 Nov. 1, 2001

(30) Foreign Application Priority Data

Apr. 10, 2000 (JP) ..... 2000-108620
Apr. 10, 2000 (JP) ..... 2000-108621

(51) Int. Cl.[7] ..... B21J 13/10
(52) U.S. Cl. ..... 72/420; 72/20.3; 72/20.5; 72/413; 72/428; 72/712; 29/753; 29/863
(58) Field of Search ..... 72/20.1, 20.2, 72/20.3, 20.5, 21.4, 413, 420, 421, 428, 442, 712; 29/751, 753, 861, 863

(56) References Cited

U.S. PATENT DOCUMENTS

| | | | |
|---|---|---|---|
| 3,931,671 | A | 1/1976 | Dittmann |
| 3,965,559 | A | 6/1976 | Mazzola |

(List continued on next page.)

FOREIGN PATENT DOCUMENTS

| | | |
|---|---|---|
| CA | 951885 | 7/1974 |
| EP | 0600416 | 6/1994 |
| EP | 0711010 | 5/1996 |
| EP | 0822627 | 3/1998 |
| FR | 2524726 | 10/1983 |
| FR | 2553683 | 4/1985 |
| FR | 2643514 | 8/1990 |
| JP | 62175685 | 11/1987 |
| JP | 4946388 | 4/1992 |
| JP | 6-251850 | 9/1994 |
| JP | 6-275363 | 9/1994 |
| JP | 7-45352 | 2/1995 |
| JP | 8-83668 | 3/1996 |
| JP | 10-50450 | 2/1998 |
| JP | 11135225 | 5/1999 |

OTHER PUBLICATIONS

English Language Abstract of JP 10–50450.
English Language Abstract of JP 11–135225.
English Language Abstract of JP 8–83668.

(List continued on next page.)

*Primary Examiner*—Ed Tolan
(74) *Attorney, Agent, or Firm*—Greenblum & Bernstein, P.L.C.

(57) ABSTRACT

In order to easily, rapidly and precisely carry out a setting work after exchange of a pressuring unit, a shank module is provided that is capable of integrally exchanging a shank of a pressing unit. The shank module is configured to removably link a main body and a ram. By adopting the universal pressing unit, adjustment after exchange of the pressing unit becomes considerably easier. Additionally, in carrying out a universal design of a terminal-feeding mechanism, improved workability is implemented by linking the setting of press conditions with the feed conditions of a terminal belt. In order to accomplish this goal, an anvil unit of a press mechanism is configured to be detachable from a main body base. Furthermore, a positioning mechanism is provided on the anvil unit. The positioning mechanism positions the setting position of moving elements of a driving mechanism of a terminal-feeding mechanism corresponding to the terminal belt. The principal part for changing of the terminal-feeding mechanism can therefore be automatically changed.

7 Claims, 31 Drawing Sheets

U.S. PATENT DOCUMENTS

| | | | | | |
|---|---|---|---|---|---|
| 4,019,362 | A | | 4/1977 | Mckeever | |
| 4,025,999 | A | | 5/1977 | Wolyn et al. | |
| 4,118,971 | A | | 10/1978 | Izraeli | |
| 4,617,731 | A | | 10/1986 | Carrell et al. | |
| 4,718,160 | A | | 1/1988 | Bulanda et al. | |
| 4,847,992 | A | | 7/1989 | Sato et al. | |
| 4,850,905 | A | | 7/1989 | Capp et al. | |
| 5,018,270 | A | | 5/1991 | Caumanns | |
| 5,142,765 | A | | 9/1992 | Tanaka | |
| 5,277,050 | A | | 1/1994 | Deross et al. | |
| 5,357,669 | A | | 10/1994 | Orphanos et al. | |
| 5,491,887 | A | | 2/1996 | Quinn | |
| 5,491,994 | A | * | 2/1996 | Baldyga | 72/20.1 |
| 5,575,061 | A | | 11/1996 | Tsuji et al. | |
| 5,661,898 | A | | 9/1997 | Matsuzawa | |
| 5,706,570 | A | * | 1/1998 | Inoue et al. | 29/753 |
| 5,765,278 | A | | 6/1998 | Koike et al. | |
| 5,799,391 | A | | 9/1998 | Tillotson | |
| 5,852,868 | A | | 12/1998 | Soriano | |
| 5,887,469 | A | * | 3/1999 | Maeda et al. | 72/20.1 |
| 5,967,395 | A | | 10/1999 | Ito | |
| 6,067,828 | A | * | 5/2000 | Bucher et al. | 72/21.4 |
| 6,161,407 | A | * | 12/2000 | Meisser | 72/21.4 |
| 6,327,775 | B1 | * | 12/2001 | Oishi et al. | 29/751 |

OTHER PUBLICATIONS

English Language Abstract of JP 6–251850.
English Language Abstract of JP 6–275363.
English Language Abstract of JP 7–45352.
English Language Abstract of French Patent Application No. 2553683.
English Language Abstract of French Patent Application No. 2643514.

* cited by examiner

TERMINAL-CRIMPING DEVICE

BACKGROUND OF THE INVENTION

1. Field of the Invention

The present invention relates to a terminal-crimping device.

2. Description of Background Information

A terminal-crimping device is generally known as a device that connects a crimping terminal with the terminal end of a coated electric wire. In general, the terminal-crimping device is a device unitizing a terminal belt-feeding mechanism for feeding a terminal belt and a press mechanism that severs terminals from the terminal belt fed and crimps the terminals on an electric wire. The device is designed to allow a crimping process to be continuously carried out by linking the respective mechanisms.

Heretofor, the press mechanism of a terminal-crimping device was equipped with a shank linked with the ram of a press device and a pressing unit installed on the shank. The pressing unit was equipped with a pressing member including a wire crimper and an insulation crimper, which are raised and lowered by the ram of the press device through the shank. Thus, terminals have been configured for crimping in cooperation with a pressed side member.

Therefore, in order to crimp a terminal between a crimper and an anvil, the setting of a so called crimp height (crimping height of a terminal) is required to comply with the crimper. Accordingly, a crimp height adjusting mechanism for adjusting the crimp height has been conventionally provided on the above-mentioned shank.

In such a construction, in order to link a terminal belt-feeding mechanism with a press mechanism, both mechanisms conventionally have been connected in a mechanical manner by a cam link provided on a shank. Accordingly, it was required to exchange the entire terminal-crimping device (including the anvil and crimping) device whenever a change of the type of terminal was needed.

However, frequent change of the type of terminal (terminal belt) recently has become required because of the diversification of terminals, requests for a small quantity production with diversified specifications, and the like.

Accordingly, the terminal belt-feeding mechanism and the press mechanism have been made into modules in recent years, and each is configured to allow a partial exchange to be made and designed to enhance universal usability. For example, an anvil capable of being installed and removed against the main body of a terminal-crimping device is disclosed in Utility Model SHO No. 62-175685.

Furthermore, a crimping unit capable of being installed on and removed from the block member on the main body side of a terminal-crimping device is disclosed in Japanese Patent Publication (Unexamined) Hei No. 10-50450.

The crimping unit is connected with the ram of a press device in order to crimp a terminal on a coated electric wire, and the crimping unit was equipped with a wire crimper for crimping wire barrels formed on the terminal, an insulation crimper for crimping insulation barrels, and a holder integrally supporting these members. Furthermore, the crimping unit was configured for installation and removal of a shank fixed on the ram.

Additionally, a terminal-crimping device having a movable element capsule for changing feeding conditions in accordance with the type of terminal belt (for example, a prescribing member for prescribing a feeding pawl and the feeding pitch of the feeding pawl) and a driving mechanism for driving the moving element (for example, an air cylinder) is disclosed in Japanese Patent Publication (Unexamined) Hei No. 11-135225.

Thus, in the above-mentioned conventional construction, since the crimping unit has been configured for installation and removal of a shank and the exchange of a crimping member such as a crimper or the like has been carried out, a crimp height adjusting mechanism provided on the shank was configured separately from the crimping unit. Accordingly, it was required to reset a crimp height without fail after changing a crimping unit, and there is a problem that it takes a long time to carry out the adjusting work after exchange of the crimping unit.

Additionally, when press conditions (specifically, the setting conditions of an anvil and a crimper) were changed according to a press mechanism, a terminal belt-feeding mechanism had to be individually set for different processes in accordance with the above-mentioned conventional construction, which inevitably caused a problem for adjusting both setting conditions.

In particular, since the arrangement and a moving range of the moving elements also require individual change in accordance with dimensional differences in the terminal belt to be fed, respectively, because the moving elements of the terminal-feeding mechanism usually encompass a plurality of factors (for example, a member for changing a feeding pitch during feeding of a terminal belt, and/or a guide member for guiding the terminal belt), and therefore a longer time has been required for changing such setting conditions.

SUMMARY OF THE INVENTION

Considering the above-mentioned problems, the present invention was achieved, and an object of the present invention is to provide a terminal-crimping device that can easily, rapidly and precisely carry out the positioning work after exchange of a pressing unit. Another object is to provide a terminal-crimping device that improves workability by linking the positioning condition of a press condition with the feed condition of a terminal belt in order to ensure the universal usability of a terminal-feeding mechanism.

In order to solve the above-mentioned problems according to one aspect of the present invention, a terminal-crimping device is provided that includes a press mechanism for crimping a terminal on a coated electric wire and a terminal-feeding mechanism which feeds a terminal belt into the press mechanism. A main body is assembled onto the press device, and a shank is provided that is guided to be reciprocably movable on the main body and connected with a ram of the press device. A pressing unit is also provided that is driven by the shank, and a shank module that includes the shank is provided to allow the shank to be integrally exchangeable with the pressing unit. Furthermore, the shank module is detachably connected with the main body and the ram.

In another aspect of the invention, the shank is linked with the main body and the ram such that it can be installed and detached as an integral element of the shank module including the pressing unit. Thus, it is possible to exchange the shank module for each type of terminals to be crimped by forming the shank module to be separable from the main body. Additionally, an adjusting function of crimp height may be set for each shank module, and the integral installation and removal of the main body and together with the pressing unit can be carried out, and the adjustment after exchange of the pressing unit becomes considerably easier when the pressing unit is designed for universal usability.

In a further aspect of the present invention, the pressing unit includes a wire crimper which crimps a wire barrel formed on the terminal, and an insulation crimper which crimps an insulation barrel, and the shank has a crimp height adjusting mechanism which permits adjustment by relatively displacing respective crimper heights relative to the ram.

Thus, the adjustment of the crimp height can be preliminarily made with each pressing unit, and the crimp height can also be more precisely adjusted after exchange of the pressing unit.

In another aspect of the present invention, the terminal-crimping device includes a linking mechanism that links reciprocating motion of the press mechanism with a feeding motion of the terminal-feeding mechanism. The linking mechanism includes a feeding motion detector that detects the feeding motion of the terminal-feeding mechanism, and a crimping motion detector that detects the crimping motion of the press mechanism. The terminal crimping device also includes a control that carries out motion control of the terminal-feeding mechanism and the press mechanism based on detection signals of both detection means.

According to another aspect of the present invention, when the motion of the shank is linked with the terminal-feeding motion by the terminal-feeding mechanism, the linking can be configured as an electrical control. Therefore, it becomes possible to further simplify the shape of the shank and to accelerate the production of modules.

In a further aspect of the invention, a terminal-crimping device is installed on the main body, and an opening and closing member is provided to open and close between an installation and removal position capable of installing and removing the shank within a reciprocating space where the shank is raised and lowered and a blocking position that regulates the removal of the shank arranged in the reciprocating space. An operator is provided that operates the opening and closing motion of the opening and closing member.

Thus, the installation and removal/exchange of the shank can be carried out without using tools by opening and closing the opening and closing member with an operator member.

In another aspect of the present invention, a terminal-crimping device is provided with a press mechanism that crimps a terminal on a coated electric wire. The device includes a terminal-feeding mechanism which feeds a terminal belt, on which a plurality of terminals are continuously supported by a carrier in parallel at fixed intervals, into the press mechanism in order to feed the terminals into the press mechanism. A base that supports the press mechanism and the terminal-feeding mechanism is also provided, and the press mechanism is constructed to be able to be exchanged within the base in accordance with the type of terminal to be crimped. The terminal-feeding mechanism includes moving elements by which the feeding condition can be changed in accordance with the type of terminal belt, and a driving mechanism for driving the moving elements. A positioning mechanism for positioning a setting position of the moving elements by the driving mechanism corresponding to terminal belt is provided on the press mechanism.

In a further aspect of the present invention, the principal parts of the terminal-feeding mechanism can be automatically changed according to the positioning mechanism provided on the press mechanism, by changing the position of the press mechanism when the feed condition of the terminal belt is changed. According to the present invention, a feeding pawl for feeding the terminal belt to a process processing, a prescribing member for prescribing the feeding pitch of the feeding pawl, and a guide for the terminal belt fed are examples of "moving elements". Furthermore, the drive according to the driving mechanism may be a drive for the positioning motion of the terminal-feeding, and may be a drive for a feeding motion for feeding the terminal belt.

In a further aspect of the present invention, the press mechanism includes an anvil unit that receives a terminal, the anvil unit being exchangeable in accordance with the terminal type, and the positioning mechanism is provided on the anvil unit. In this mode, since only the anvil unit can be changed from the entire press mechanism, the universal usability of the press mechanism can be further enhanced, and since the positioning mechanism is provided on the anvil unit, the positioning change of the terminal-feeding mechanism can be automatically carried out corresponding to the anvil unit even if the anvil unit is changed.

In still another aspect of the present invention, the driving mechanism includes a first driving member, which concurrently holds a clamping device that clamps the exchanged press mechanism. In this mode, the installation and removal process of the press mechanism and the drive of a fixed moving element (for example, a guide member) can be simultaneously carried out by the single driving member (for example, an air cylinder), and a rapid position change can be carried out by simpler construction.

In a still further aspect of the present invention, the driving mechanism includes a second driving member, which sequentially drives another moving element against a positioning device of the press mechanism which engages the first driving member. Thus, since the position of the residual moving element can be designed in relation with the press mechanism which is positioned by the first driving member when the positioning of the press mechanism is carried out by the first driving member, a precise positioning can be positively carried out even if a plurality of moving elements exist.

BRIEF DESCRIPTION OF DRAWING

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the several forms of the present invention may be embodied in practice.

The preferred embodiments of the present invention are illustrated in detail below while referring to drawings attached.

Figure 1:
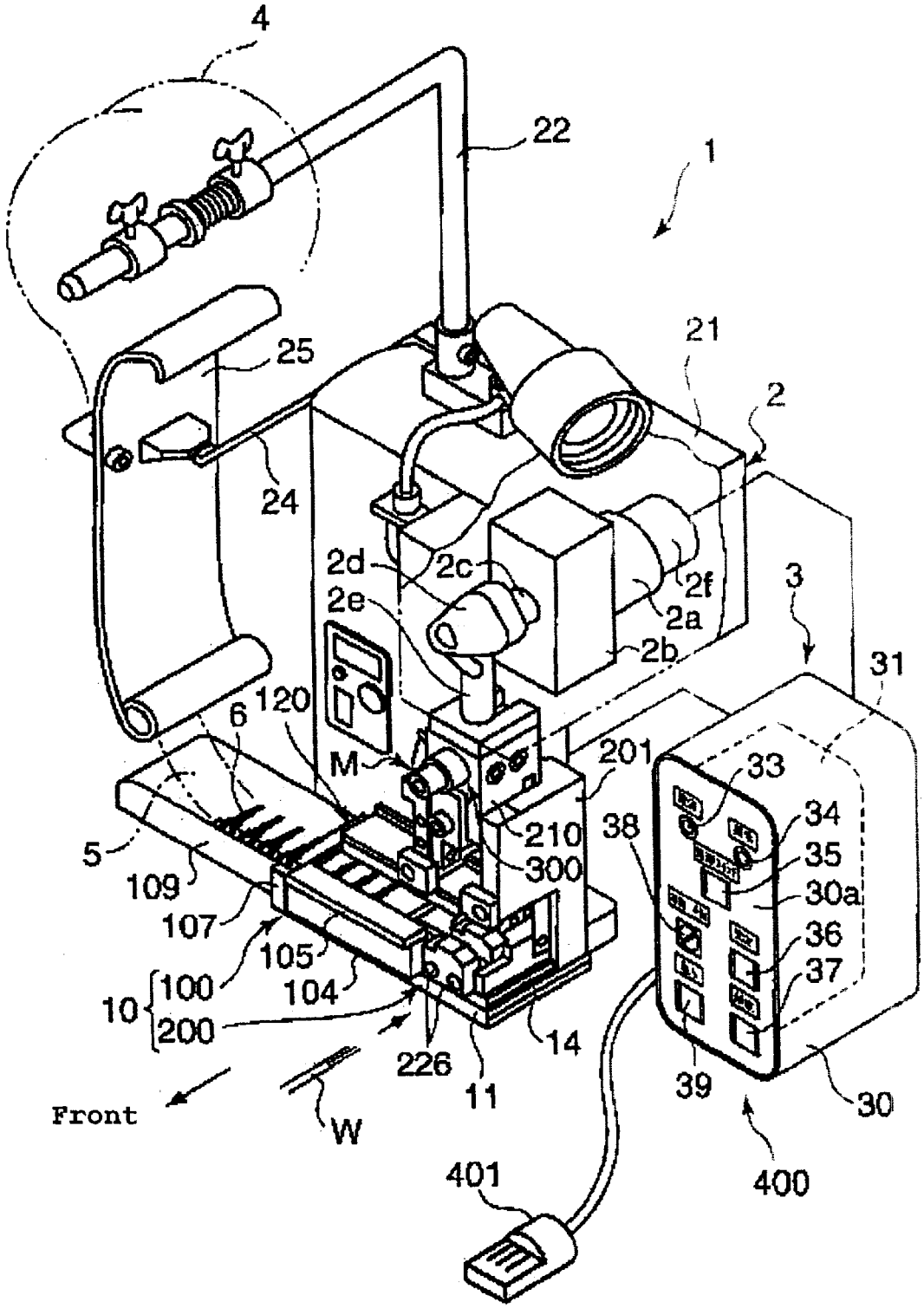
FIG. 1 is a perspective view showing the entire construction of the terminal-crimping device relating to a first embodiment of the present invention.
Figure 2:
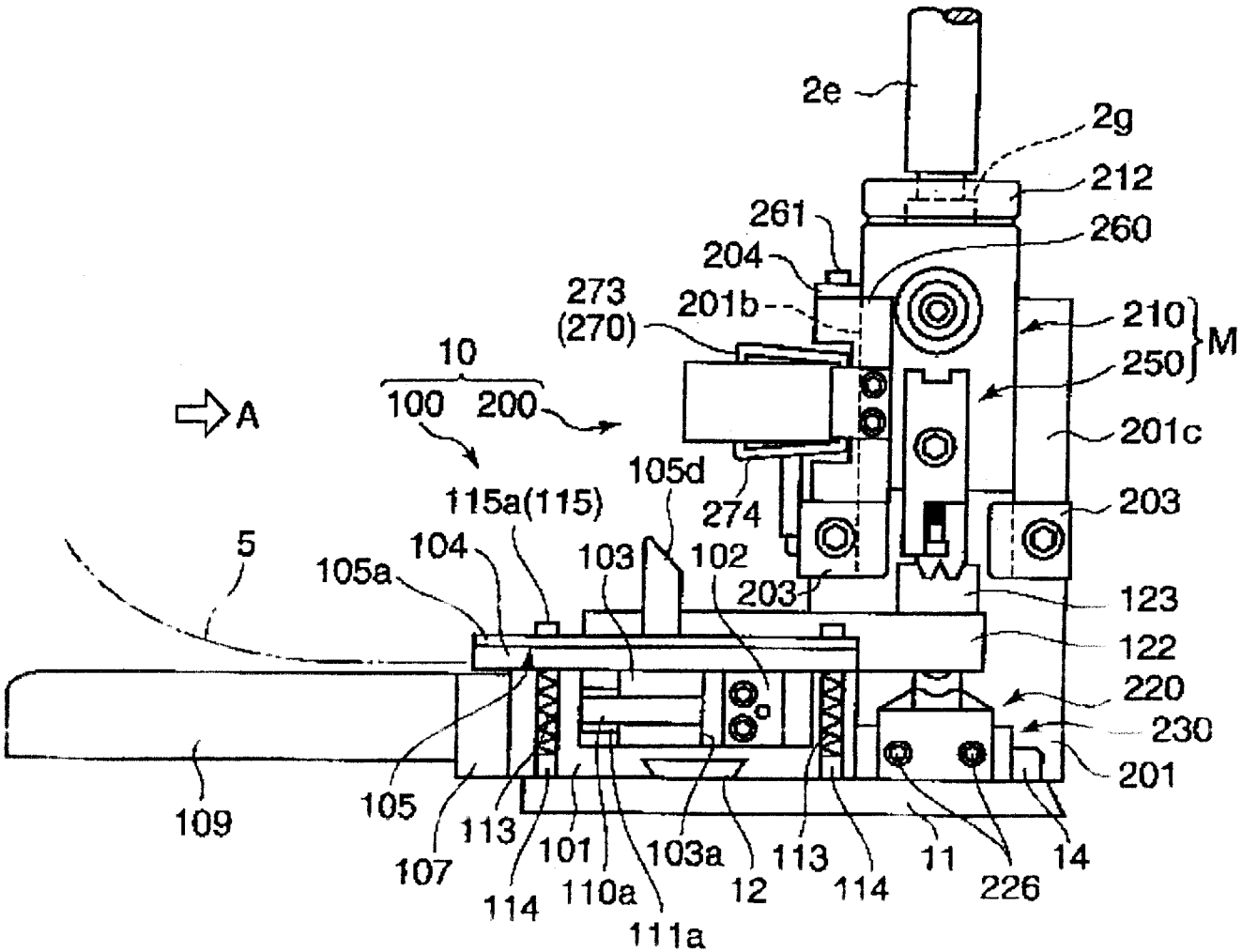
FIG. 2 is a front view showing the terminal-crimping device.

FIG. 1 is a perspective view showing the entire construction of the terminal-crimping device related to a first embodiment of the present invention. FIG. 2 is a front view showing the terminal-crimping device. Referring to these drawings, a press device 1 illustrated has a terminal-crimping device 10, a servo unit 2 for driving the terminal-crimping device 10, and a control box 3 for controlling these devices. A worker (not illustrated) is utilized to feed a coated electric wire W in front of the press device 1 and to crimp terminals 6 onto the end of the coated electric wire W. Furthermore, the side at which the worker is positioned is temporarily referred to as the "front".

The terminal-crimping device 10 includes a base 11 which is installed on the press device 1, a terminal-feeding mechanism 100 and a press mechanism 200 are mounted on the base 11 (note FIG. 2).

The servo unit 2 includes a servo motor 2*a*, a rotational shaft 2*c* which is driven by the servo motor 2*a* through a decelerator 2*b* connected with the servo motor 2*a*. A reciprocating ram 2*e* connected with the rotational drive shaft 2*c* through a link 2*d* transfers the torque of the servo motor 2*a* to the reciprocating ram 2*e* by converting it to a reciprocating motion by the link 2*d*, and is configured to raise and lower the shank module M, which is provided on the lower end of reciprocating ram 2*e* of the press mechanism 200 of the terminal-crimping device 10.

In the example illustrated, an encoder 2*f* is connected with the servo motor 2*a*. The encoder 2*f* is connected with the control box 3, and is configured to be drive-controlled.

As shown in FIG. 1, a generally L-shaped arm 22 is mounted on the housing 21 of the servo unit 2, and a terminal belt reel 4 is configured for installation on the free end of the arm 22. Furthermore, a guide plate 25 is fixed to the housing 21 through an installation arm 24. A terminal belt 5 fed out from the terminal belt reel 4 is fed out from the outer side of the guide plate 25 to the terminal-feeding mechanism 100 of the terminal-crimping device 10, and is configured to be fed to the press mechanism 200 of the terminal-crimping device 10.

Figure 3:
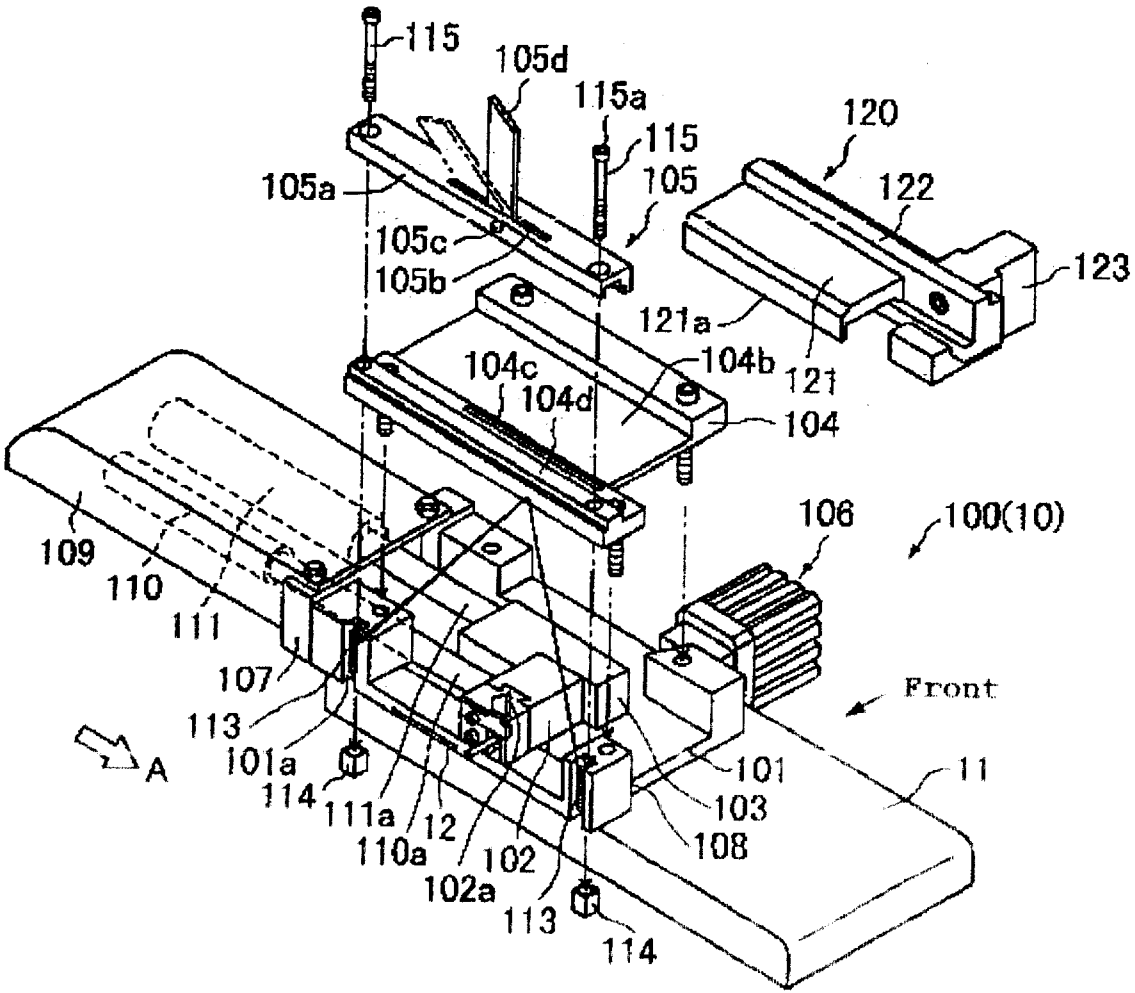
FIG. 3 is an exploded perspective view of the terminal-feeding mechanism of the crimping device related to the embodiment of FIG. 1.

FIG. 3 is an exploded perspective view of the terminal-feeding mechanism 100 of the crimping device 10 related to the embodiment of FIG. 1.

Referring to FIG. 2 and FIG. 3, the terminal-feeding mechanism 100 of the terminal-crimping device 10 is provided with a unit base 101 which is guided by a guide rail 12 (note FIG. 2) which extends laterally of the base 11 and can be displaced in back and forth directions. A feeding pawl block 102 and a setting block 103, which prescribes the feed pitch of the feeding pawl block 102, are mounted on the unit base 101. A unit plate 104 is arranged on the upper part of the unit base 101 and is configured to permit displacement of both the blocks 102 and 103. A brake unit 105 is mounted on the upper part of the unit plate 104.

The unit base 101, the feeding pawl block 102, and the setting block 103 are movable elements of the terminal-feeding mechanism 100 in the embodiment illustrated. A plurality of different size terminal belts 5 are designed to be fed by changing the positions of the above-noted elements, in a manner to be described later.

The unit base 101 includes a slide cylinder 106 provided on the rear of the base 11 so as to be able to be displaced in the lateral direction of the base 11. Thus, terminal belts 5 having different widths are able to be universally fed by displacing the unit base 101 relative to the press mechanism 200 at the time of setting a feed condition, in a manner to be described later.

A cylinder block 107 is mounted on the up-stream end of the unit base 101 in the terminal belt-feeding direction A, as shown in FIG. 3. A feed cylinder 110 which drives the feeding pawl block 102 back and forth along the terminal belt-feeding direction A at the movement of terminal-crimping (to be described later), and a feed amount-setting cylinder 111 which can drive the setting block 103 back and forth along the terminal belt-feeding direction A at the time of setting a feed condition (to be described later), are installed on the cylinder block 107. Rods 10*a*, 111*a* of the respective cylinders 110, 111 are connected with the corresponding blocks 102, 103 (refer to FIG. 3). Together with the slide cylinder 106, the cylinders 110, 111 constitute the driving mechanism for the terminal-feeding mechanism 100 in the embodiment illustrated.

The upper surfaces of the cylinders 110, 111 are covered with a cylinder cover 109 which is fixed to the cylinder block 107 in a cantilever fashion. Furthermore, the upper surface of the cylinder cover 109 concurrently serves as a guide member for guiding the terminal belt 5 paid out from the terminal belt reel 4 onto the unit plate 104 of the unit base 101 (note FIG. 1). The terminal belt 5 is configured to be intermittently fed at a fixed timing, under the conditions where it is guided on the unit plate 104, by the feeding pawl block 102.

Figure 4:
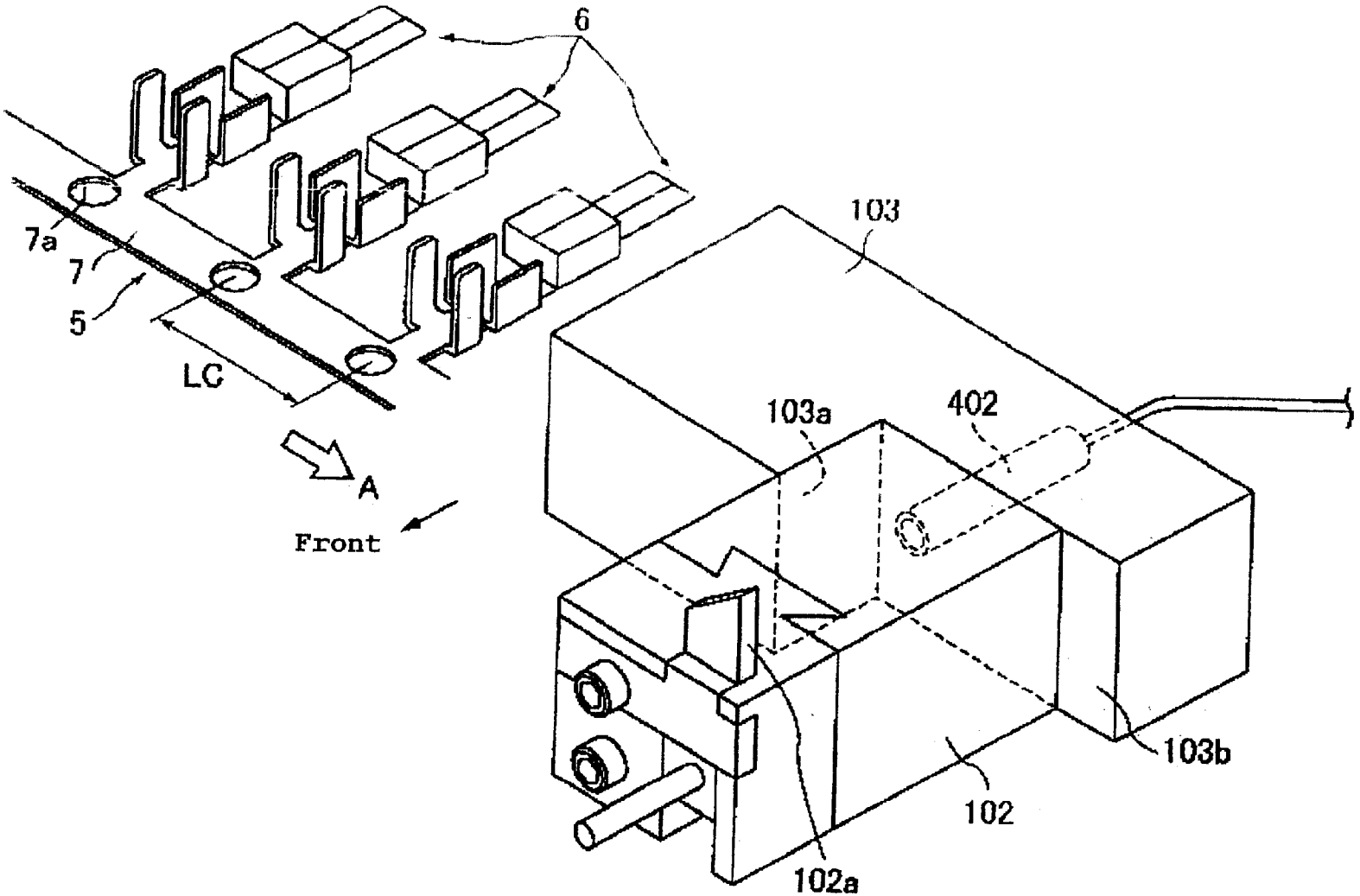
FIG. 4 is an enlarged perspective view showing the principal part of the terminal-feeding mechanism related to the embodiment of FIG. 1.

FIG. 4 is an enlarged perspective view showing the principal part of the terminal-feeding mechanism related to the embodiment of FIG. 1.

Referring to FIG. 4, this type (the so called side type) of terminal belt 5 is a belt in which crimping terminals 6, arranged in parallel at fixed intervals LC, are connected on a belt type carrier 7. Pilot holes 7*a*, corresponding to the respective clamping terminals 6, are formed in the carrier 7 by punching. Furthermore, the feeding pawl block 102 has a feed pawl 102*a* which can be inserted into and removed from the pilot holes 7*a*. The terminal belt 5 is driven by inserting the feed pawl 102*a* into the pilot holes 7*a* and by moving the entire feeding pawl block 102 in the terminal belt-feeding direction A by the feed cylinder 110 by an amount corresponding to the fixed interval LC, and the crimping terminals 6 are configured to be fed to the press mechanism.

As illustrated in FIG. 4, the feeding pawl 102*a* is chamfered to have an angular shape in which the up-stream side in the terminal belt-feeding direction A is lowered. The feeding pawl is configured to project and retract upwardly and downwardly under the conditions where it is energized upward and downward by an elastic member (not illustrated). Accordingly, when the feeding pawl 102*a* moves from the up-stream side to the downstream side, it retracts from the pilot holes 7*a* by being guided by the chamfered part, returns to the original feeding position, and can be inserted into the pilot holes 7*a* which succeed to the up-stream side.

The setting block 103 includes a generally L-shaped recess that forms a stop surface 103*a* confronting the terminal belt-feeding direction A and a guide surface 103*b* orthogonal to the direction A. The stop surface 103*a* is configured to set the return position of the feeding pawl block 102 at a double-acting motion, while the guide surface 103*b* guides the rear face of the feeding pawl block 102 in a slidable manner.

Figure 5:
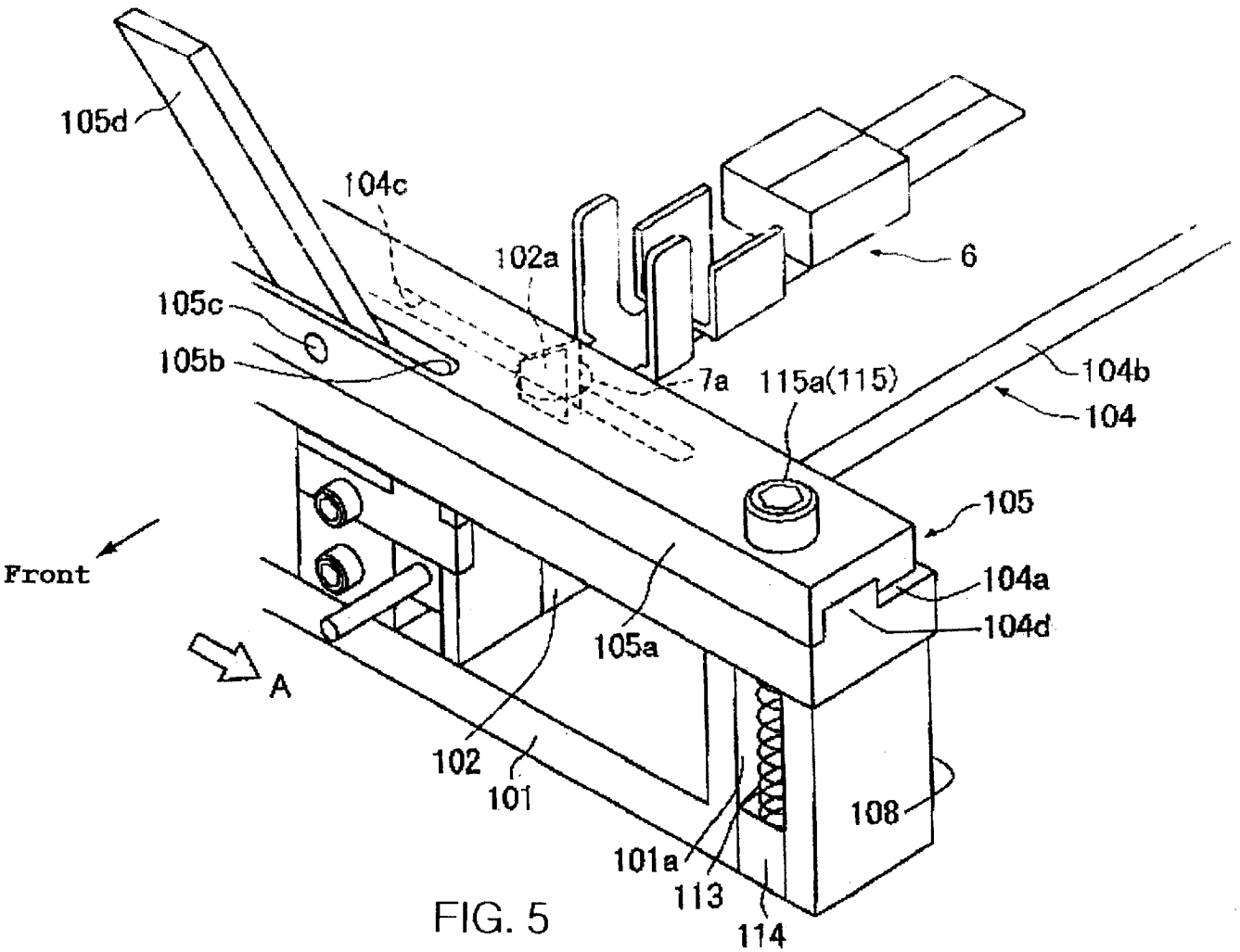
FIG. 5 is an enlarged perspective view showing the unit plate part of the terminal-feeding mechanism related to the embodiment of FIG. 1.

FIG. 5 is an enlarged perspective view showing the unit plate 104 of the terminal-feeding mechanism related to the embodiment of FIG. 1.

Referring to FIG. 3 and FIG. 5, the unit plate 104 has a carrier feeding groove 104*a* which is formed beneath the brake unit 105. A panel portion 104*b* receives the crimping terminals 6 of the terminal belt 5 and the carrier 7 is transported within the carrier feed groove 104*a*. An elongated groove 104*c* is formed in the lower face of the carrier feed groove 104*a* and receives the feeding pawl 102*a*, and a rib 104*d* is provided for mounting the brake unit 105. The crimping terminals 6 of the terminal belt 5 are designed for arrangement on the panel portion 104*b* and are fed to the press mechanism 200.

The brake unit 105 includes a brake plate 105*a* which forms the upper part of the carrier feed groove 104*a*, and a cam lever 105*d* is installed in an elongated opening 105*b* formed at the central part of the brake plate 105*a*. The cam lever 105*d* prevents the feeding pawl 102*a* from adversely feeding against the terminal belt-feeding direction A by elastically pushing down the carrier 7 of the terminal belt 5 against the lower surface of the carrier feed groove 104*a* below the brake plate 105*a*. A vertically extending rectangular groove 101*a* is formed at opposite ends of the unit base 101.

In order to elastically bias the brake plate 105*a*, a coil spring 113 is arranged within each groove 101*a*. A rectangular nut 114 is arranged beneath the coil springs 113, and a bolt 115 that penetrates the brake plate 105*a* and the unit plate 104 is threaded into the nut 114 such that it passes through the inner periphery of the coil spring 113. Accordingly, the nut 114 is pushed downward by compression of the coil spring 113 between the nut 114 and the unit plate 104. As a result, since the biasing force is transmitted from the head 115*a* of the bolt 115 to the brake plate 105*a*, the portion constituting the carrier feed groove 104*a* elastically pushes the carrier 7 onto the unit plate 104, and the brake plate 105*a* is designed to prevention adverse reverse feeding of the carrier 7.

Furthermore, the cam lever 105*d* is mounted on the brake plate 105*a* by a pivot pin 105*c*, and is configured to rotate between a brake releasing position shown by the solid lines in FIG. 3 and a brake actuating position shown as phantom lines in FIG. 3 and in solid lines in FIG. 5. Then, at the brake releasing position, the cam lever 105*d* elevates the brake plate 105*a* resisting the biasing force of the coil spring 113 by a lower part thereof protruding from the lower part under the brake plate 105*a*, and at the brake actuating position, the lower part is retracted within the brake plate 105*a*. Thus, the biasing force of the coil spring 113 acts on the brake plate 105*a* in the above-described manner.

The crimping terminals 6 of the terminal belt 5, which are fed onto the unit plate 104 are configured to be guided by the upper guide 120 provided on the press mechanism 200.

Referring to FIG. 3, the upper guide 120 has a guide plate 121, a rectangular rod guide block 122 which supports the guide plate 121, and a slide block 123 provided on one end of the guide block 122. The guide plate 121 is configured to substantially guide the crimping terminals 6 of the terminal belt 5.

Figure 6:
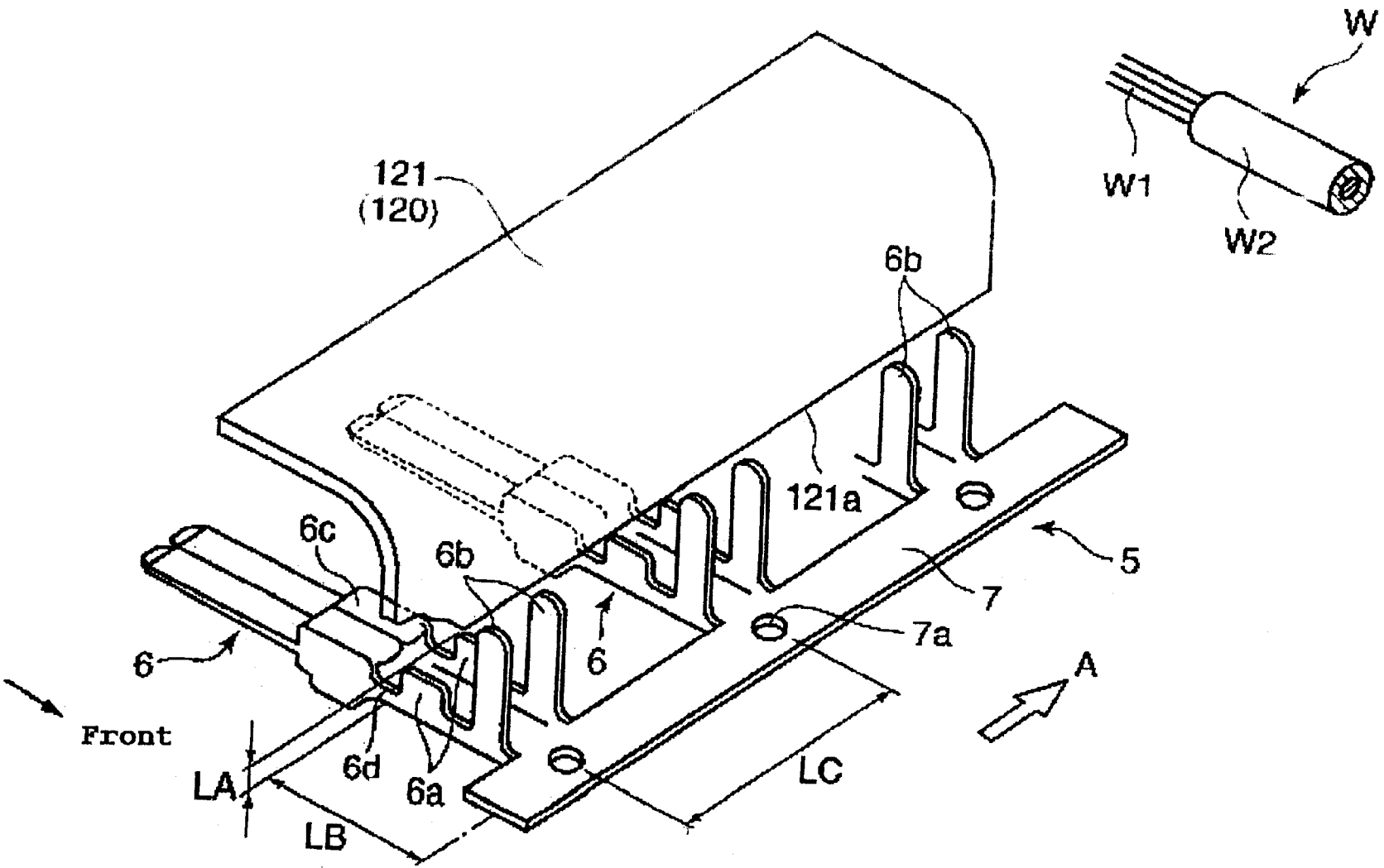
FIG. 6 is a perspective view showing the principal part of the guide related to the embodiment of FIG. 1.

FIG. 6 is a perspective view showing the principal part of the upper guide related to the embodiment of FIG. 1.

Referring to FIG. 6, as widely known, the crimping terminals 6 have wire barrels 6*a*, which are crimped on the core wire part W1 of the coated electric wire W, and insulation barrels 6*b*, which are crimped on the coated end part W2 at the front of the connection parts 6*c*. Furthermore, in the example illustrated, the guide plate 121 is bent so that the guide rim 121*a* of the guide plate 121 can guide along the guide grooves 6*d* that are formed between the connection parts 6*c* and the wire barrels 6*a*.

Figure 7:
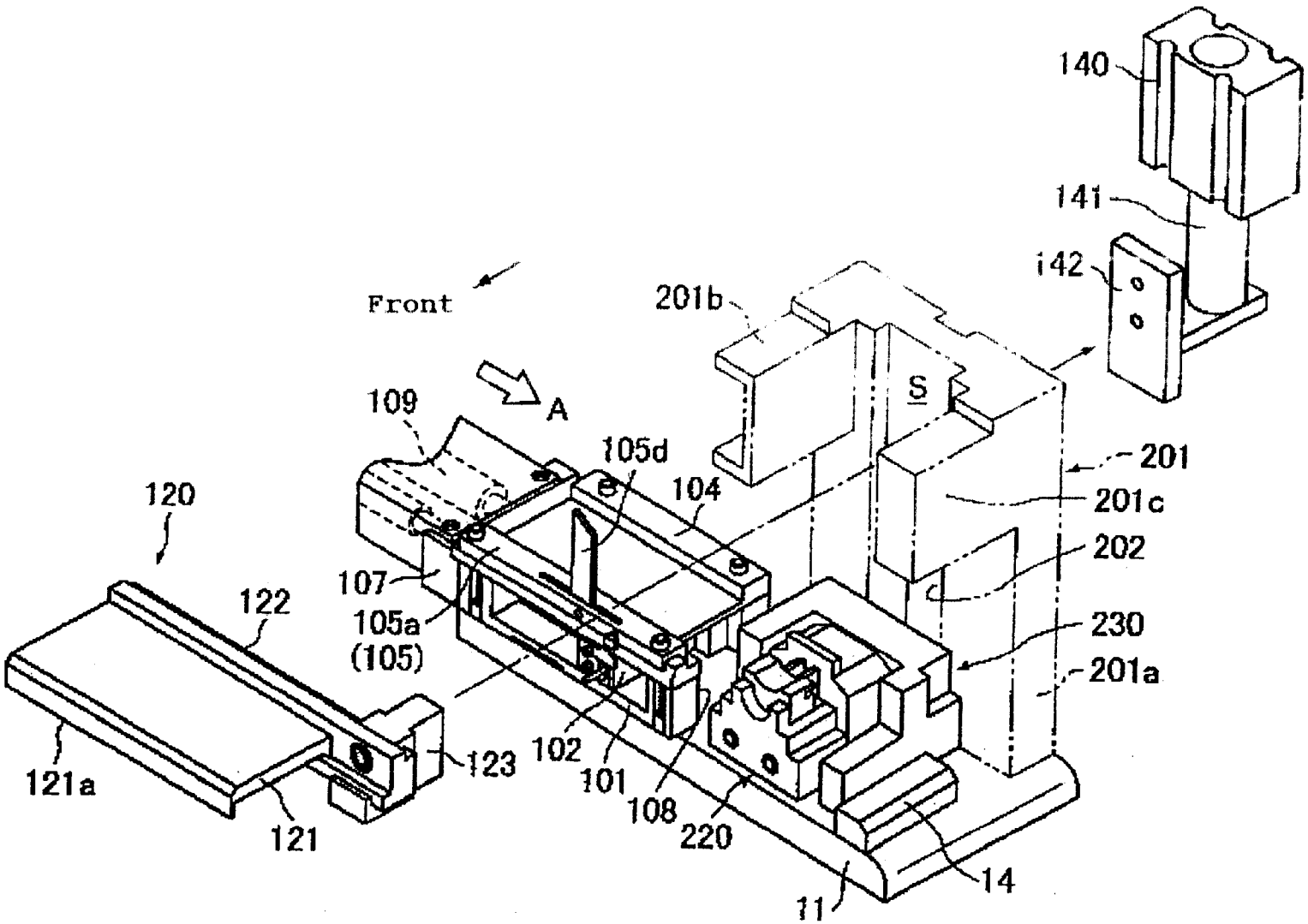
FIG. 7 is an exploded perspective view showing a portion of the crimping device related to the embodiment of FIG. 1.
Figure 8:
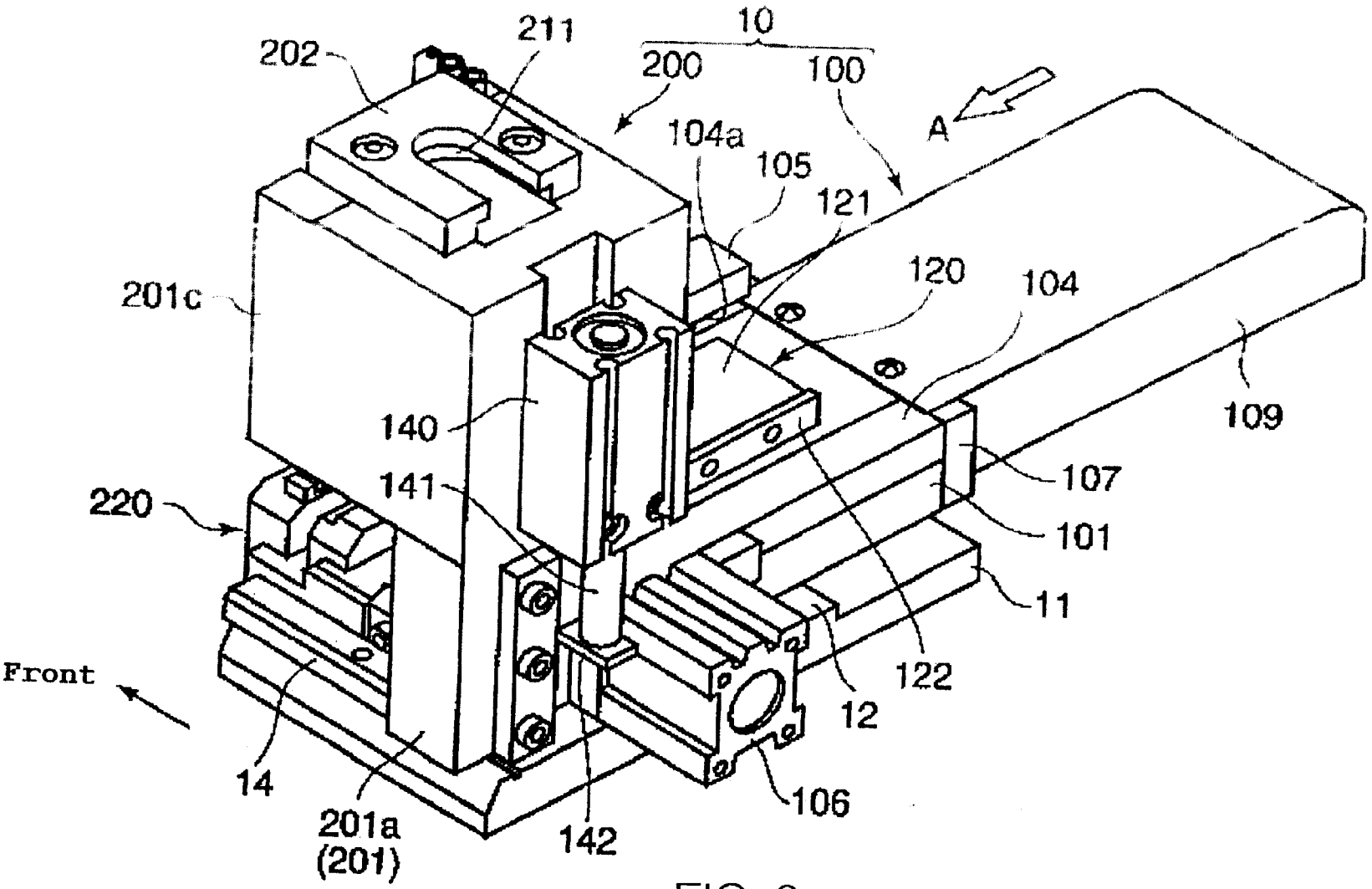
FIG. 8 is a rear perspective view of the crimping device related to the embodiment of FIG. 1.
Figure 9:
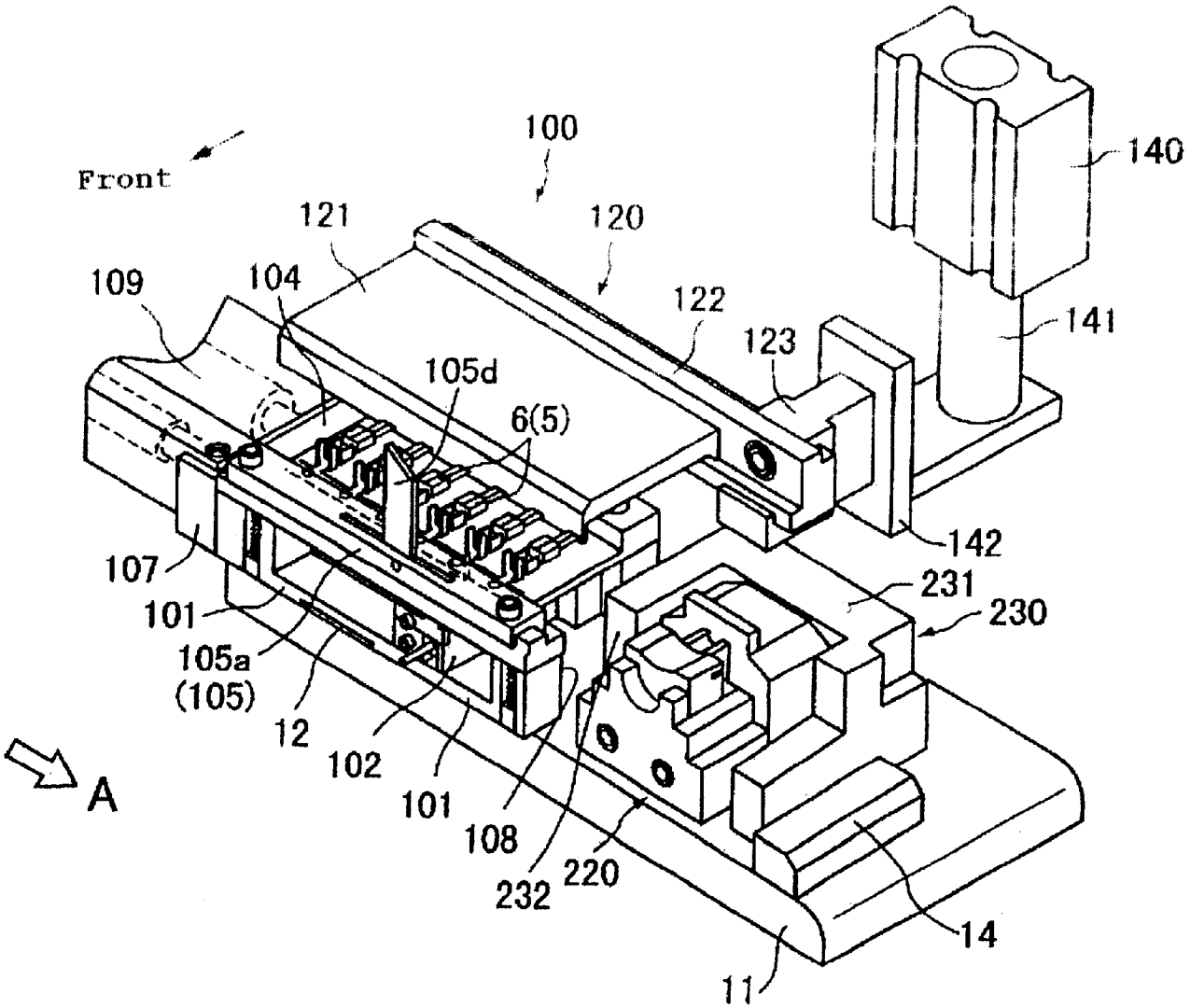
FIG. 9 is a perspective view showing a portion of the crimping device related to the embodiment of FIG. 1.
Figure 10:
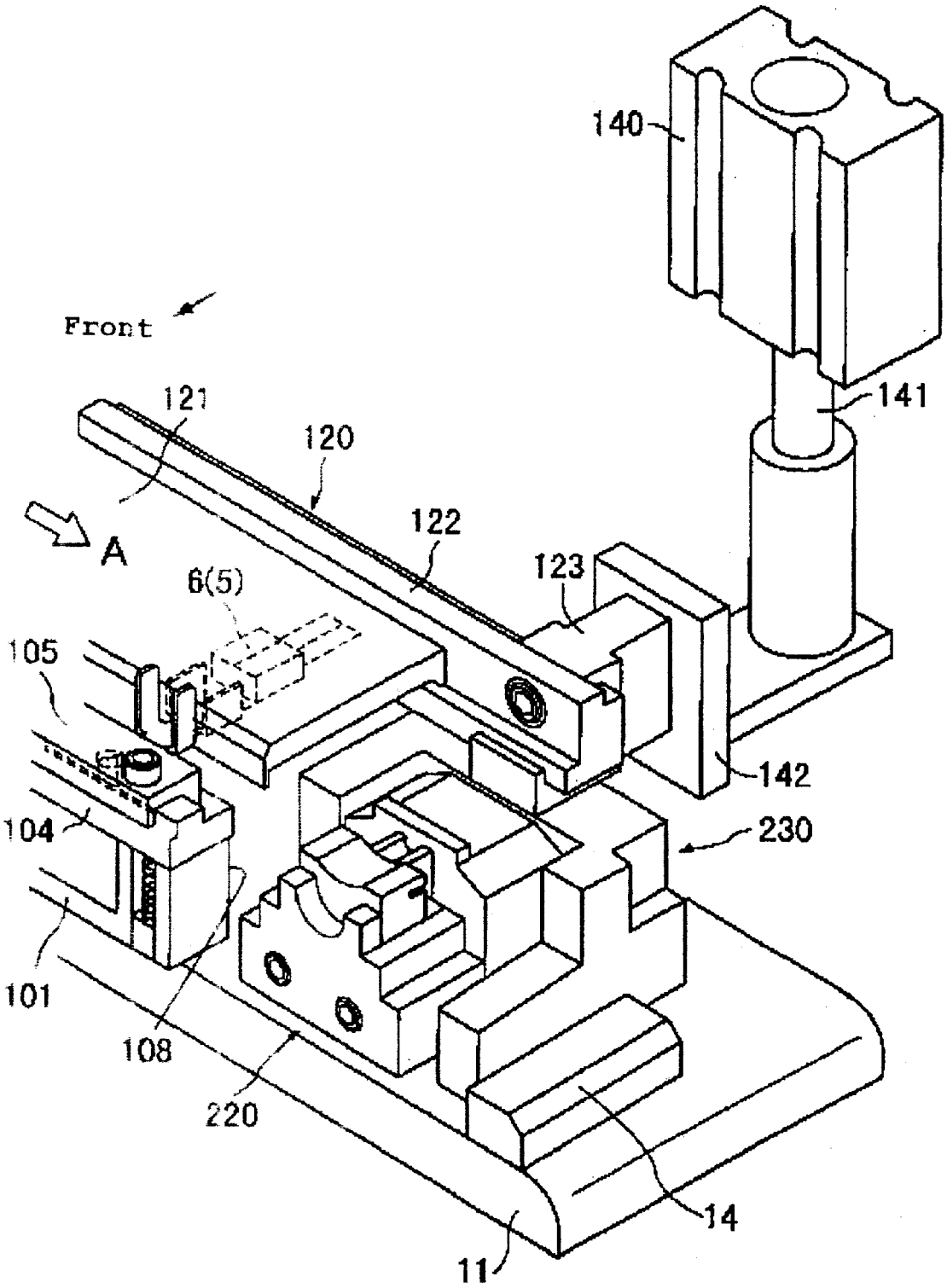
FIG. 10 is an enlarged perspective view showing the principal part of the crimping device related to the embodiment of FIG. 1.

Next, the drive structure of the upper guide 120 is illustrated with reference to FIG. 7 to FIG. 10. FIG. 7 is an exploded partial perspective view showing in part the crimping device related to the embodiment of FIG. 1. FIG. 8 is a rear perspective view of the crimping device related to the embodiment of FIG. 1. FIG. 9 is a partial perspective view showing in part the crimping device related to the embodiment of FIG. 1. FIG. 10 is an enlarged perspective view showing the principal part of the crimping device related to the embodiment of FIG. 1.

Referring to these drawings, the upper guide 120 is configured so that it can be moved up and down by a clamp cylinder 140 which is fixed on the rear face of the main body 201 of the press mechanism 200 in the manner described as follows. As illustrated, the main body 201 of the press mechanism 200 has a unitary block body 201*a* protrusively provided on the base 11, and a pair of arms 201*b*, 201*c* protruding from the upper front face of the block body 201*a*. A reciprocating space S for the crimper unit 250 (note FIG. 2), which is linked with the reciprocating ram 2*e* (note FIG. 1) of the servo unit 2, is formed between the arms 201*b* and 201*c*. Corresponding to the reciprocating space S, a window 202 that extends up and down is formed in the block body 201*a*. The slide block 123 of the upper guide 120 projects into the window 202 for up and down movement, and is installed on the cylinder rod 141 of the clamp cylinder (driving device) 140 which is fixed to the rear face of the block body 201*a*, through the connection member 142. Thus, the upper guide 120 constitutes a moving element that changes position upward and downward by elevating the slide block 123 with the clamp cylinder 140.

In the embodiment illustrated, the slide block 123 concurrently holds a fixation device for fixing the anvil unit 220 which is arranged under the reciprocating space S. Furthermore, in the embodiment illustrated, it is constructed such that various positionings are carried out by the anvil holder 230 provided on the anvil unit 220.

Figure 11B:
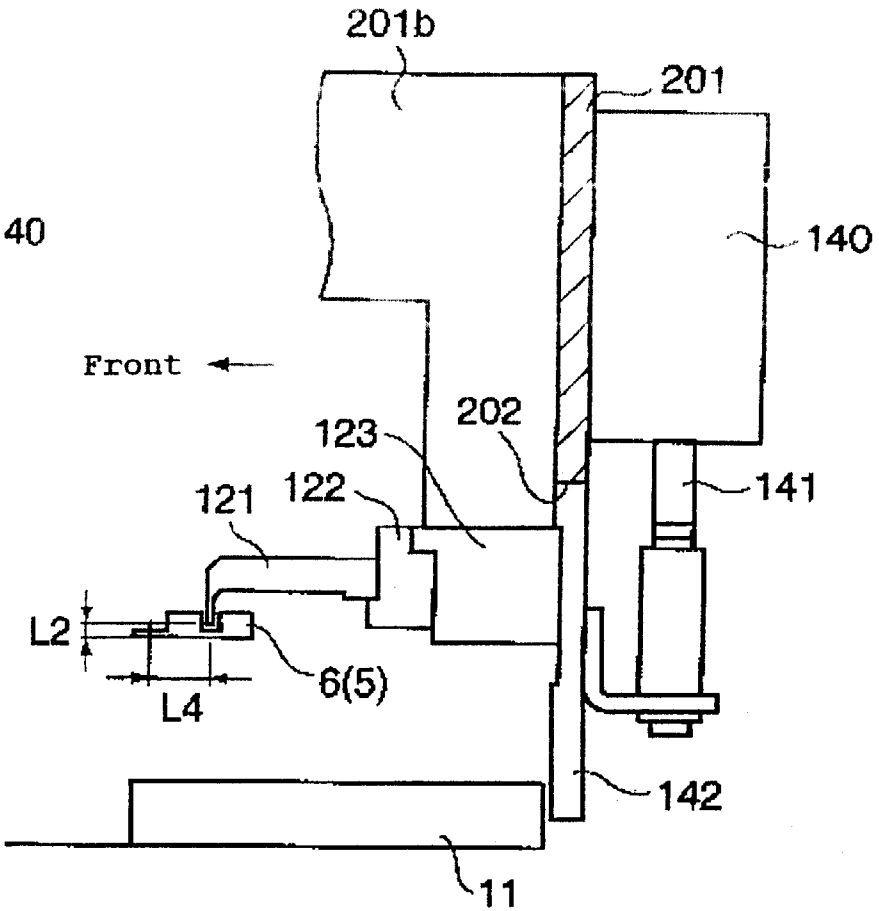
FIGS. 11(A) and 11(B) are schematic views diagrammatically showing the universal usability of the terminal-feeding mechanism relating to the embodiment of FIG. 1.
Figure 11A:
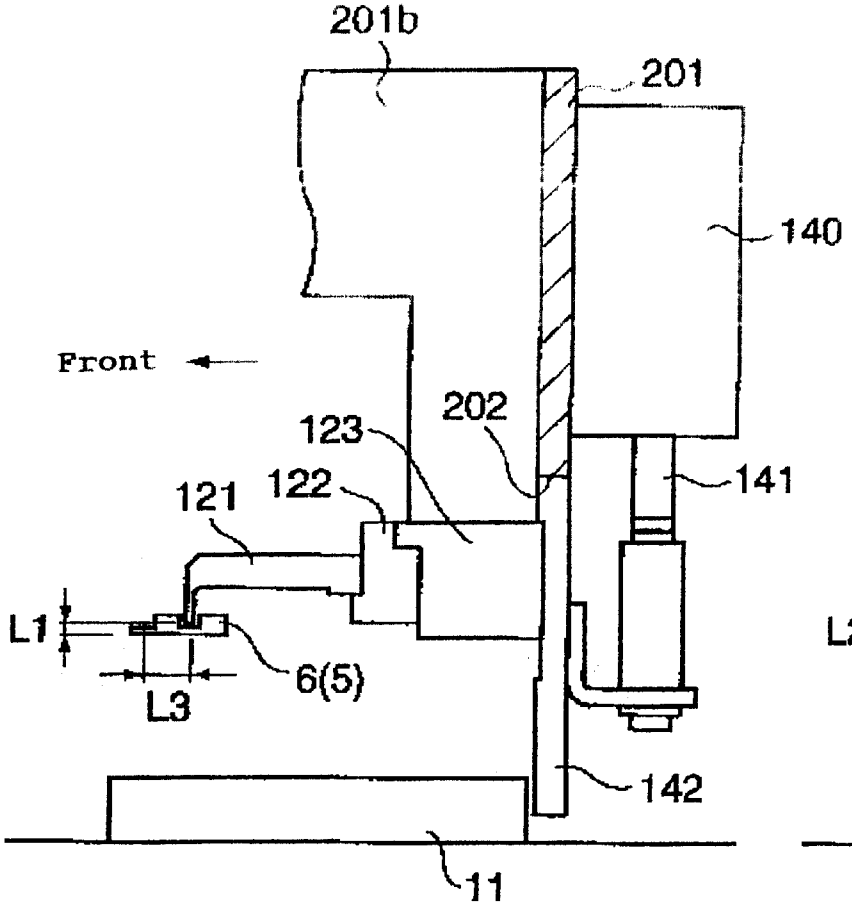
Figure 12A:
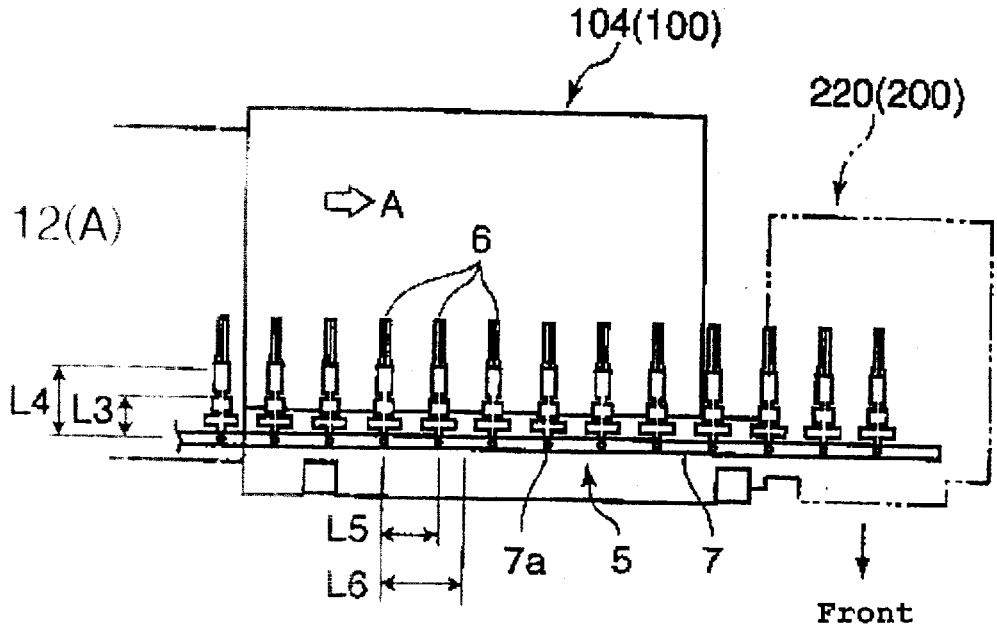
FIGS. 12(A) and 12(B) are schematic side views diagrammatically showing the universal usability of the terminal-feeding mechanism related to the embodiment of FIG. 1.
Figure 12B:
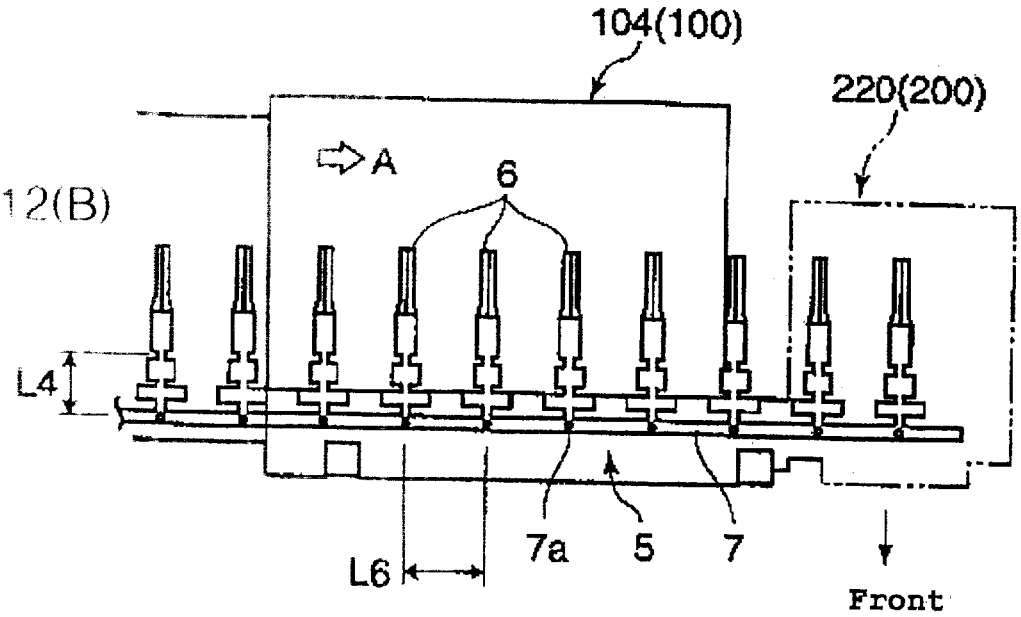

FIG. 11 is a schematic side view diagrammatically showing the universal usability of the terminal-feeding mechanism related to the embodiment of FIG. 1. Furthermore, FIG. 12 is a schematic plan view diagrammatically showing the universal usability of the terminal-feeding mechanism related to the embodiment of FIG. 1.

First, referring to FIG. 6, as the dimensions which should be controlled for feeding the terminal belt 5, there is the guide height LA from the bottom face of the guide grooves 6*d* to the guide position according to the guide rim 121*a* of the upper guide 120, the distance LB from the pilot holes 7*a* to the guide grooves 6*d*, and the punching interval LC of the pilot holes 7*a* which are formed in the carrier 7. However, these respective dimensions LA, LB and LC are different according to the types of the crimping terminals 6. According to the present embodiment, the disparity of the respective dimensions LA, LB and LC can be absorbed by utilizing the anvil unit 220, and universal usability is provided.

Figure 13:
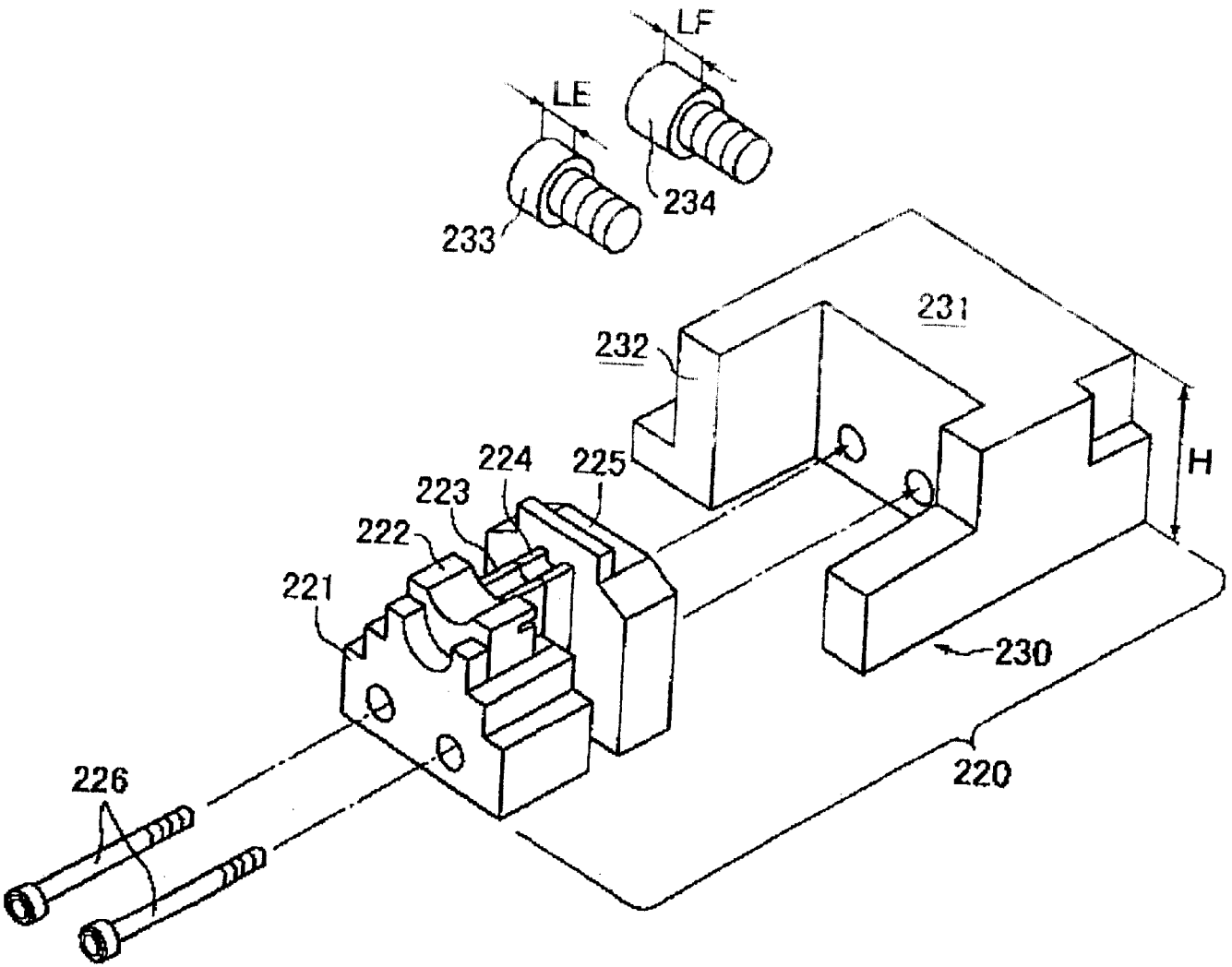
FIG. 13 is an exploded perspective view of the anvil unit related to the embodiment of FIG. 1.
Figure 14:
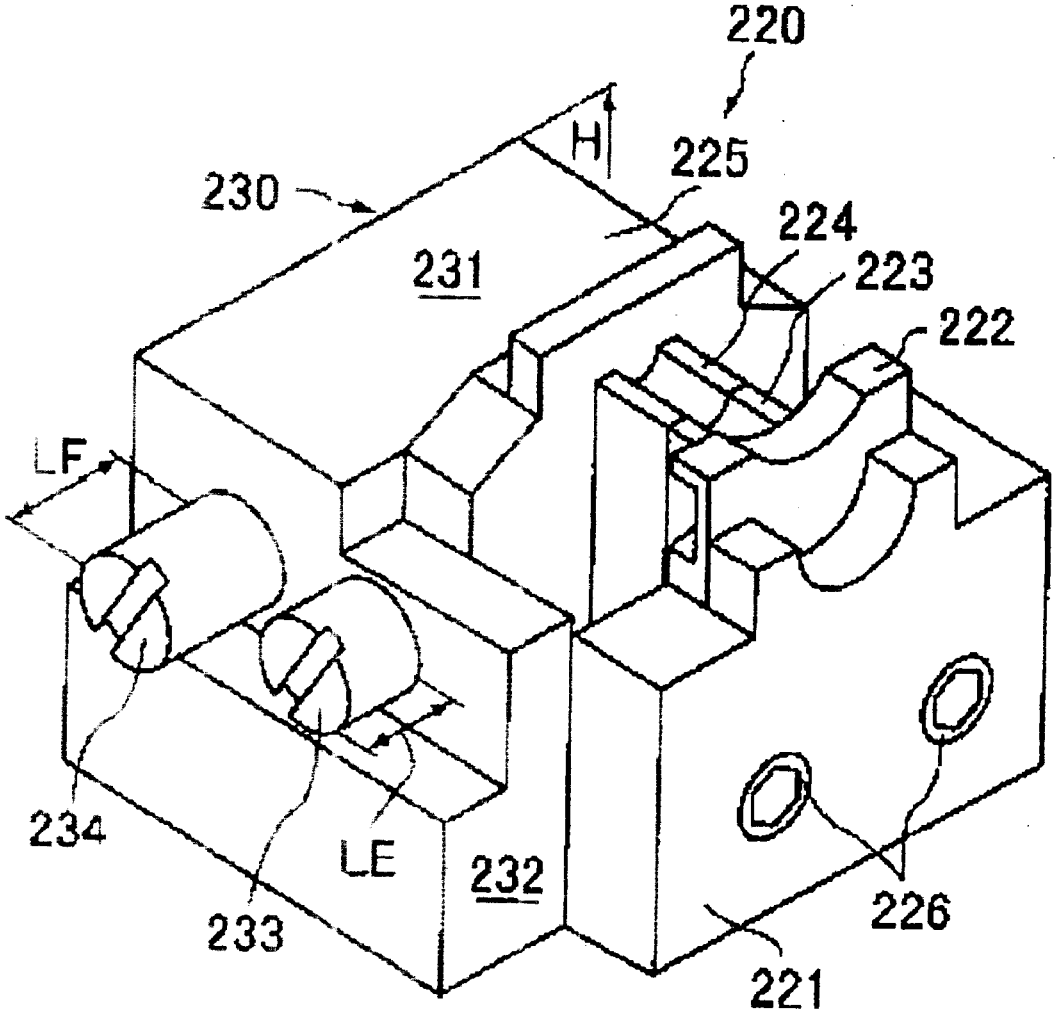
FIG. 14 is a perspective view of the anvil unit related to the embodiment of FIG. 1.

FIG. 13 is an exploded perspective view of the anvil unit related to the embodiment of FIG. 1, and FIG. 14 is a perspective view of the anvil unit related to the embodiment of FIG. 1.

Referring to these drawings, the anvil unit 220 related to the present embodiment is the basic construction element of the press mechanism 200, and includes the block body 221. A slide cutter 222 is mounted for reciprocal motion on the block body 221, an installation anvil 223 and a wire anvil 224 are sequentially connected to the back of the slide cutter 222, and a spacer 225 is provided, and are connected with bolts 226. Furthermore, an anvil holder 230 integrally supporting the respective elements 221 to 225 is provided on the anvil unit 220 related to the present embodiment. The anvil unit 220 is a block body which is formed to have a generally U-shaped configuration in plan view, the side wall at the down-stream side in the terminal belt-feeding direction is guided by a positioning member 14 fixed on the base 11, and the rear face comes in contact with the front of the main body 201 of the press mechanism 200. Therefore, it is designed to precisely position each of the anvils 223 and 244 against the crimper unit 250 to be described later.

FIG. 15 is a schematic side view of the press mechanism related to the embodiment of FIG. 1.

Figure 15A:
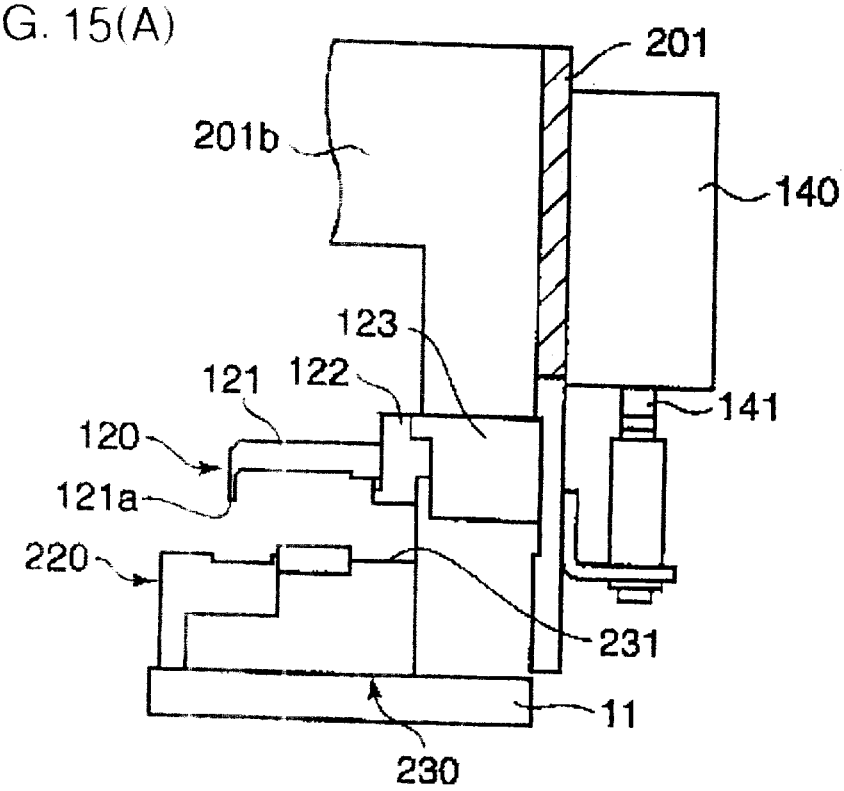
FIGS. 15(A) and 15(B) are schematic side views of the press mechanism related to the embodiment of FIG. 1.
Figure 15B:
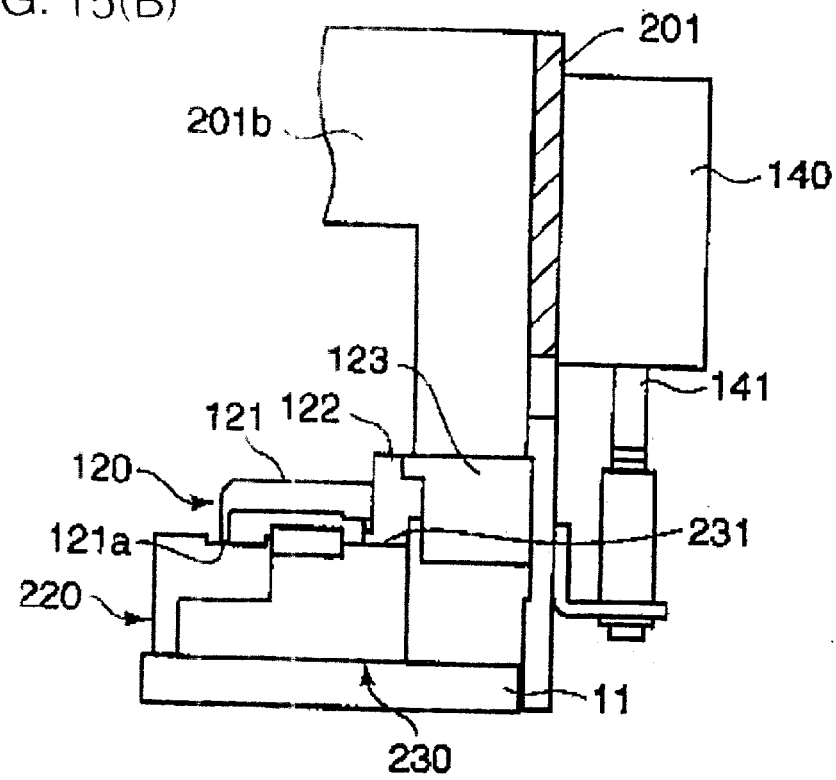

Referring to FIG. 14 and FIG. 15, a contact face 231 that confronts the slide block 123 of the upper guide 120 is formed on the anvil holder 230 assembled on the press mechanism 200. Accordingly, when the clamp cylinder 140 displaces the slide block 123 from the raised condition of FIG. 15(A) to the lowered condition of FIG. 15(B), the lower face of the slide block 123 comes in contact with the contact face 231, and is designed to lock the entire anvil unit 220.

Furthermore, the height H (see FIG. 13) of the contact face 231 coincides with the height corresponding to types of anvils 223, and 244 (namely, the crimping terminals 6 which are to be crimped) assembled. Thus, when the anvil unit 220 is changed, the stop position (setting position) where the slide block 123 stops during descent can be changed to correspond to the difference of the height H of the contact face 231. The positions of the upper and lower heights of the upper guide 120 installed on the slide block 123 are changed by the setting change of upper and lower heights, therefore the automatic setting of the guide height LA (see FIG. 6) of the terminal belt 5 can be carried out.

FIG. 16 is a schematic plan view schematically showing the positioning structure of the terminal-feeding mechanism related to the embodiment of FIG. 1.

Figure 16A:
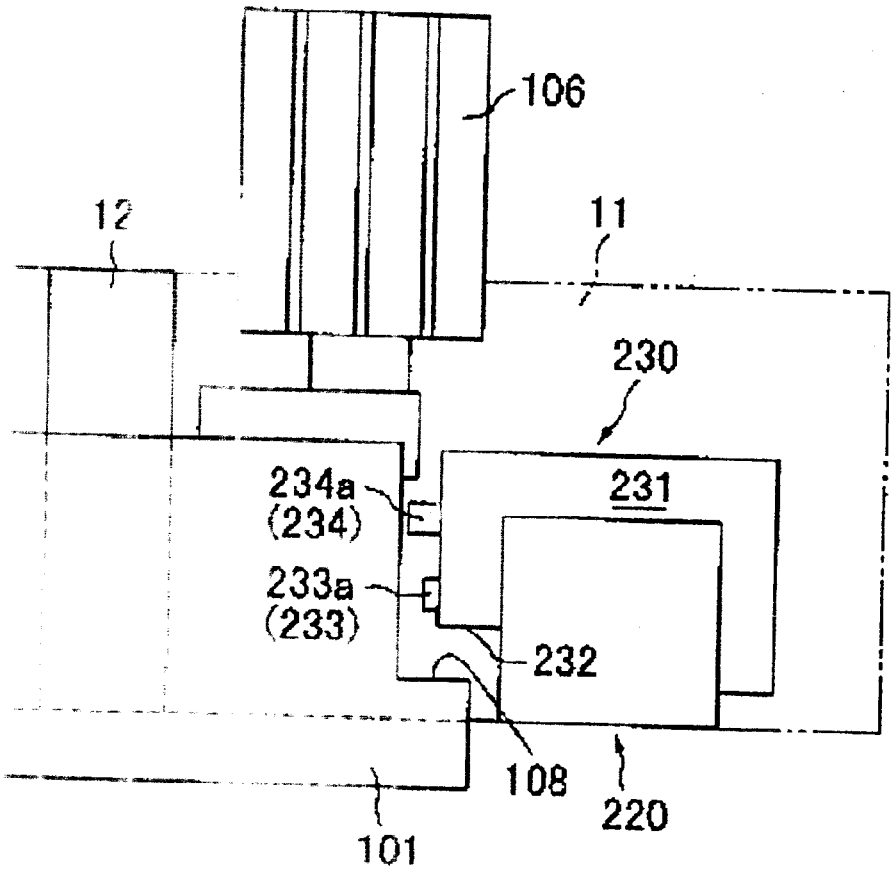
FIGS. 16(A) and 16(B) are schematic plan views schematically showing the positioning structure of the terminal-feeding mechanism related to the embodiment of FIG. 1.
Figure 16B:
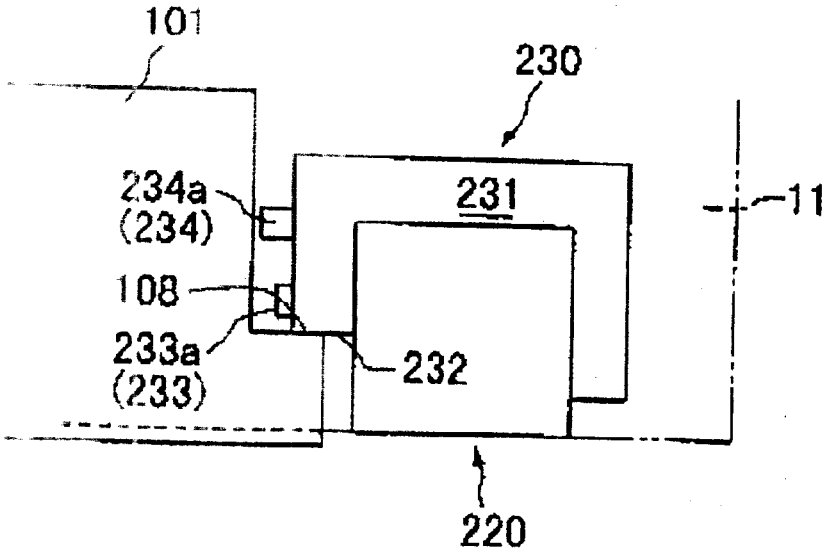

Referring to FIG. 16(A), FIG. 13 and FIG. 14, the positioning end face 232 is formed on the anvil holder 230 of the anvil unit 220 at the up-stream side in the terminal belt-feeding direction. The positioning end face 232 confronts a notched part 108 which is formed at the down-stream side in the terminal belt-feeding direction A of the unit base 101 when the anvil unit 220 is mounted. When the slide cylinder 106 changes position from the extended condition of FIG. 16(A) to the retracted condition of FIG. 16(B) and pulls the unit base 101 rearwardly, the notched part 108 comes in contact with the positioning end face 232. Therefore, the setting position in the back and forth directions of the unit base 101 can be individually established by the anvil unit 220. Thus, the distance LB from the pilot holes 7*a* to the guide groove 6*d* can be automatically set (see FIG. 6, FIG. 11 and FIG. 12) corresponding to the terminals clamped.

Figure 17:
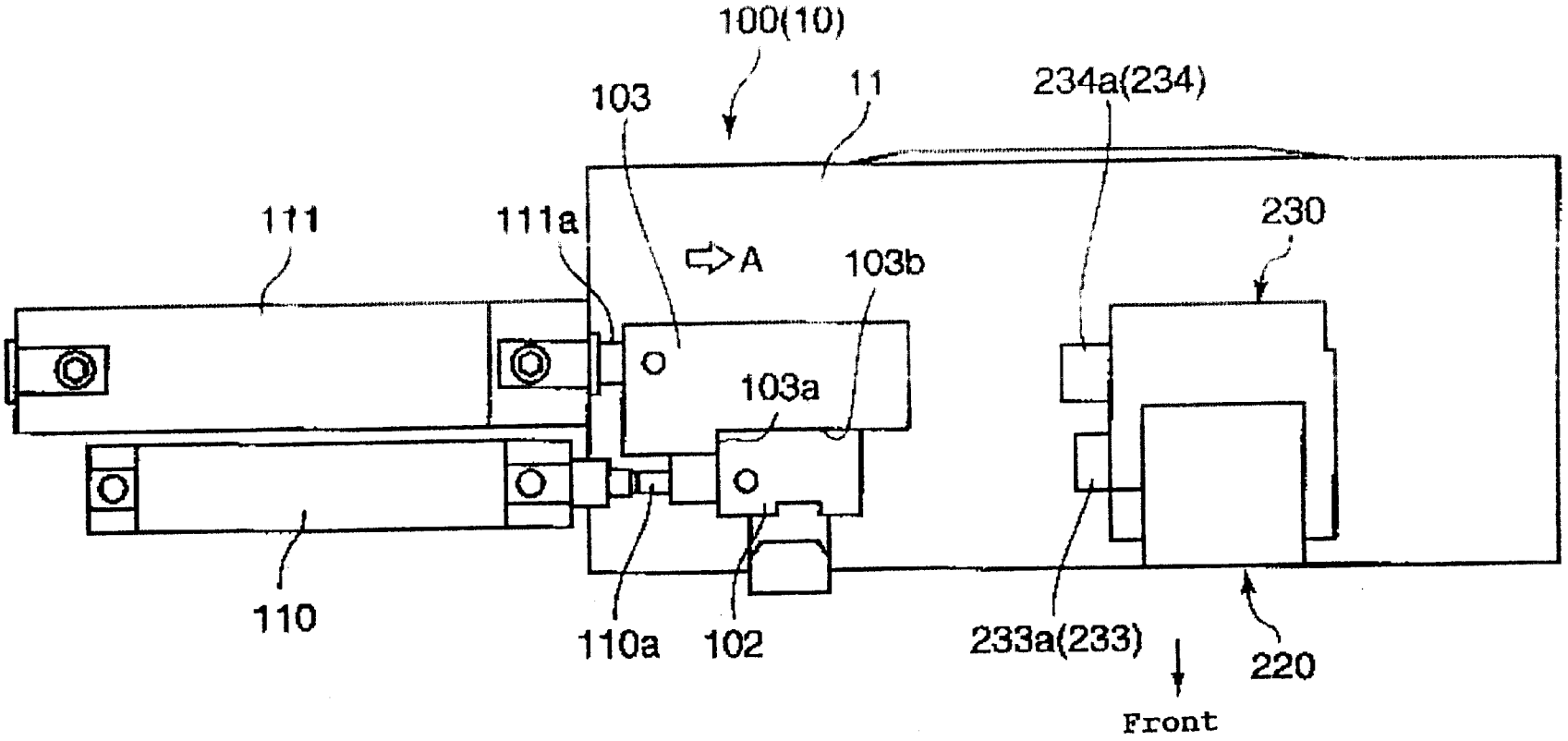
FIG. 17 is a schematic plan view schematically showing the positioning structure of the terminal-feeding mechanism related to the embodiment of FIG. 1.
Figure 18:
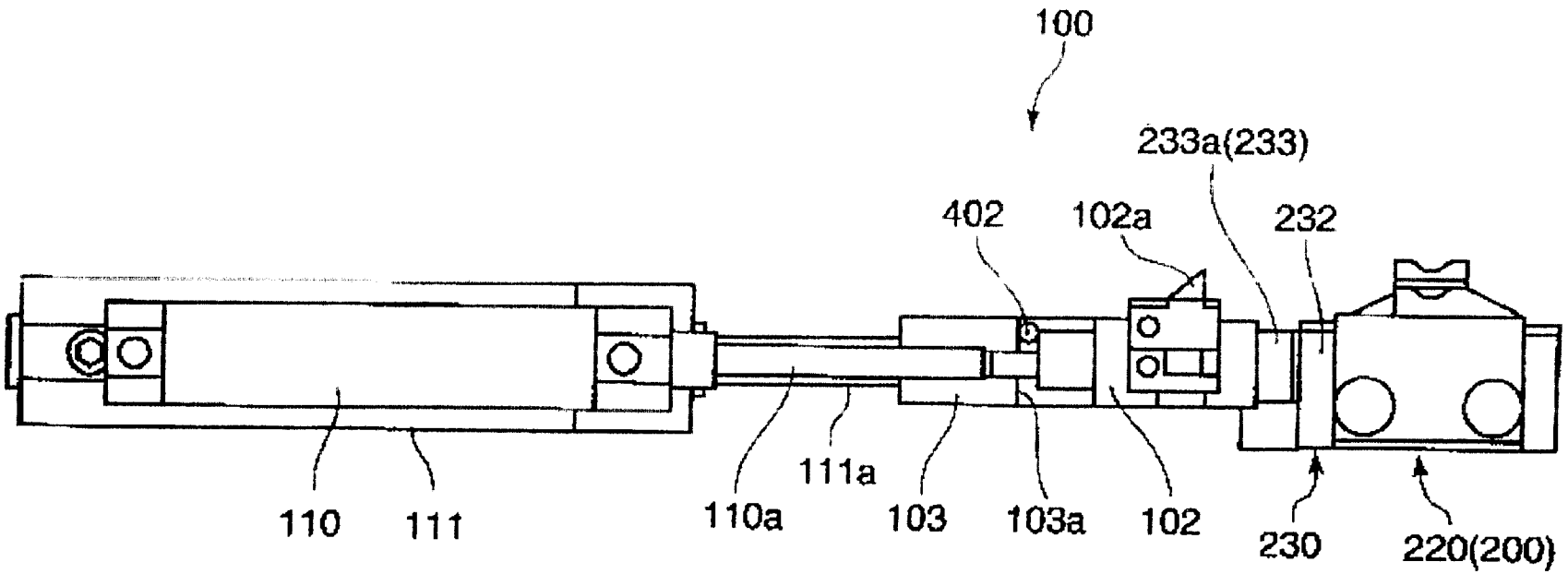
FIG. 18 is a schematic front view schematically showing the positioning structure of the terminal-feeding mechanism related to the embodiment of FIG. 1.

FIG. 17 is a schematic plan view schematically showing the positioning structure of the terminal-feeding mechanism related to the embodiment of FIG. 1. FIG. 18 is a schematic frontal view schematically showing the positioning structure of the terminal-feeding mechanism related to the embodiment of FIG. 1, and FIG. 19 is a schematic plan view schematically showing the position-establishing process of the terminal-feeding mechanism related to the embodiment of FIG. 1.

Referring to FIG. 13 and FIG. 14, and FIG. 17 to FIG. 19, a pair of adjusting bolts 233 and 234 are fixed on the anvil holder 230 of the anvil unit 220 at the side wall of the up-stream side in the terminal belt-feeding direction.

Figure 19A:
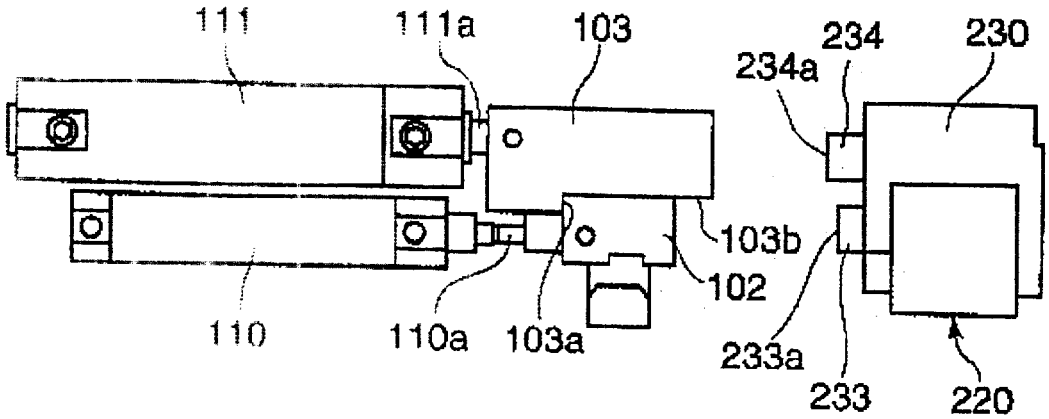
FIGS. 19(A)–19(C) are schematic plan views schematically showing the positioning setting process of the terminal-feeding mechanism related to the embodiment of FIG. 1.
Figure 19B:
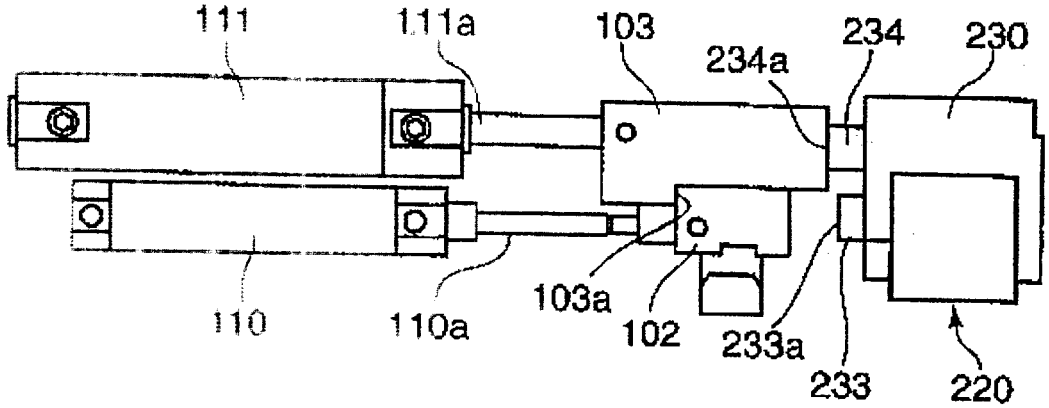
Figure 19C:
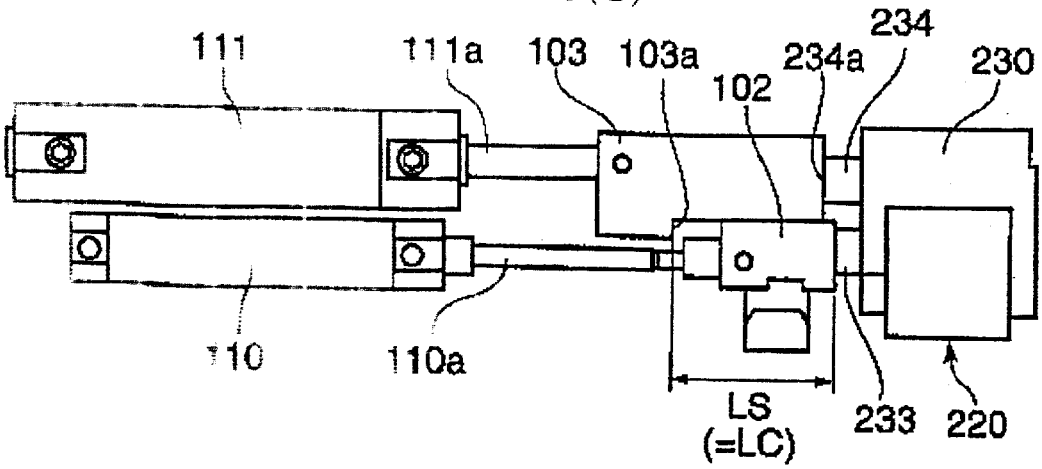

These adjusting bolts 233 and 234 position the protrusion positions (setting position) of the feeding pawl block 102 and the setting block 103, respectively, and the protruding lengths LE and LF (see FIG. 13) of the respective heads 233*a* and 234*a* are individually set, respectively, corresponding to the type of the crimping terminals to be crimped. Furthermore, as shown in FIG. 19(A), the setting block 103 first extends and is brought into contact with the corresponding adjusting bolt 234. Therefore, as shown in FIGS. 19(B), 19(C), the stroke range LS of the feeding pawl block 102 (namely, the feeding pitch of the feeding pawl 102*a* ) is designed to be automatically set between the prescription surface 103*a* of the setting block 103 and the end face of the head 234*a* of the adjusting bolt 234.

691 Next, details of the press mechanism 200 related to the present embodiment are described.

Figure 20:
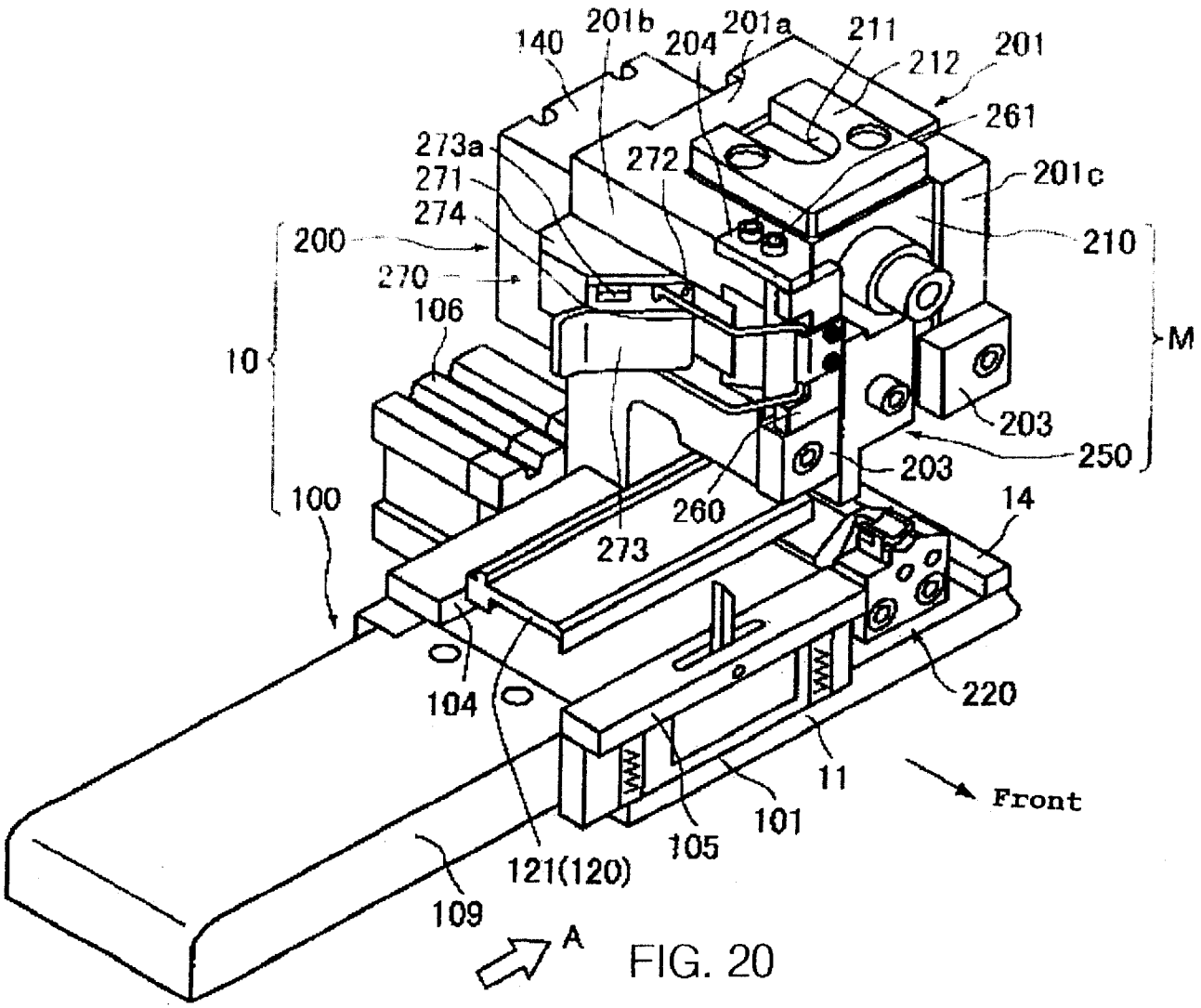
FIG. 20 is a perspective view of the terminal-crimping device related to the embodiment of FIG. 1.
Figure 21:
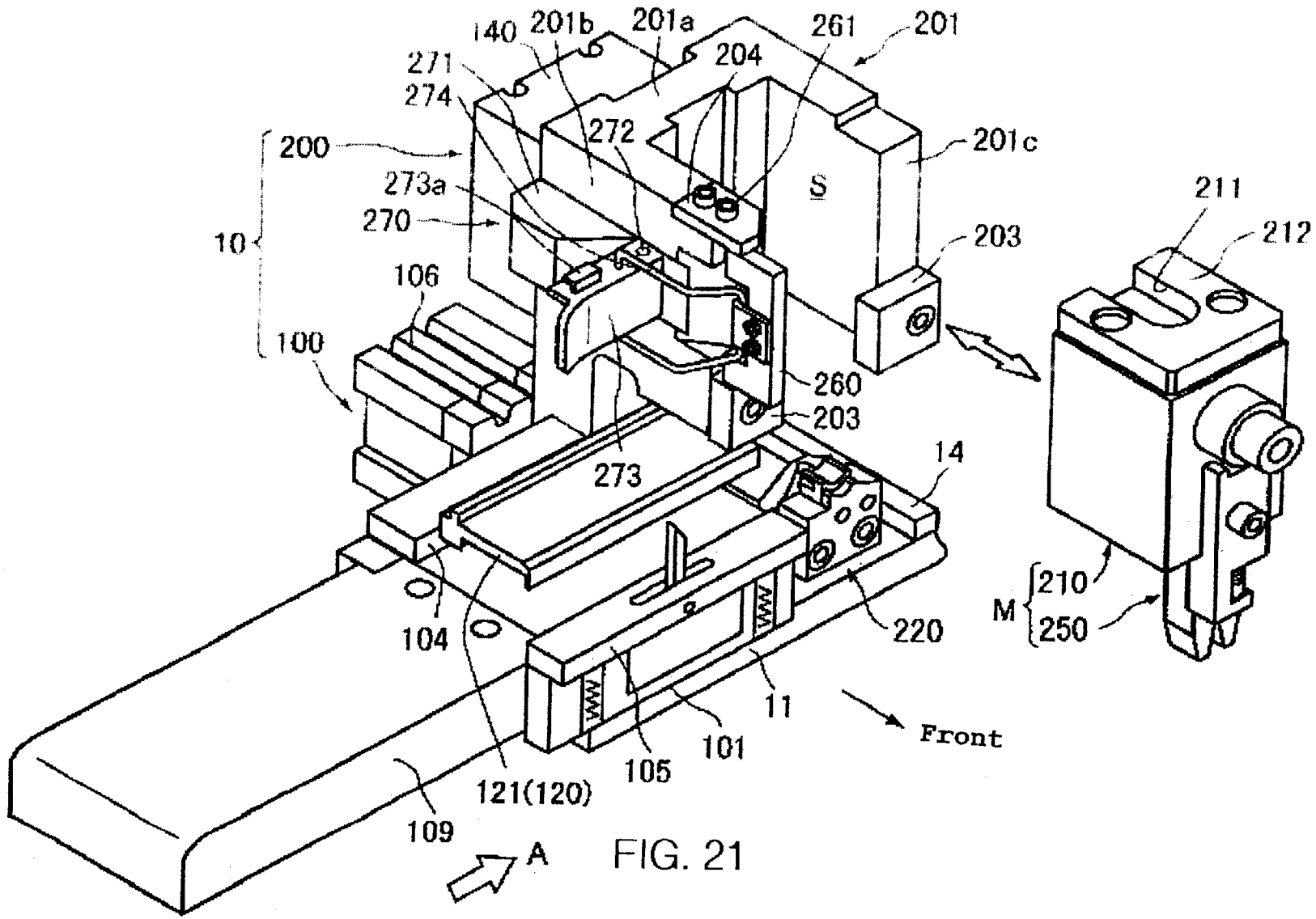
FIG. 21 is an exploded perspective view showing a portion of the terminal-crimping device related to the embodiment of FIG. 1.

FIG. 20 is a perspective view of the terminal-crimping device related to the embodiment of FIG. 1, and FIG. 21 is a perspective view showing a broken away portion of the terminal-crimping device related to the embodiment of FIG. 1.

Referring to FIG. 20 and FIG. 21, the press mechanism 200 related to the embodiment illustrated has a shank 210 which is guided up and down within the reciprocating space S formed in the main body 201. The shank 210 is a metal block member which is formed to have a generally rectangle shape as a whole, and a link 212 provided with a rearwardly opening mounting groove 211 is fixed to the upper part. Furthermore, as shown in FIG. 2, a flange 2*g* which is formed at the lower end of the reciprocating ram 2*e* of the press device 1 is mounted in the mounting groove 211 of the link shank 212. Thus, the shank 210 is designed to be driven up and down by the reciprocating ram 2*e* as a whole, within the reciprocating space S.

The reciprocating space S is formed between the pair of the arms 201*b* and 201*c* described above. A guide plate 203 is fixed in a cantilever manner at the lower front end face of the respective arms 201*b* and 201*c*, such that the shank 210 is guided at the front face of the block body 201*a*, the inside face of both arms 201*b* and 201*c*, and the rear face of the guide plate 203 so that it can be raised and lowered.

A door 260 is installed on the arm 201*b* which is one side of the main body of the press mechanism 200 related to the embodiment illustrated, and the door 260 is axially supported by a bolt 261 along a perpendicular line. The bolt 261 is provided between an installation plate 204, which is fixed on the upper end face of the block body 201 a and a guide plate 203 corresponding to the arm 201*b*, and supports the door 260. The door 260 is designed to be displaced about the bolt 261 between a blocking position which permits the shank 210 to move only in the up and down directions within the reciprocating space S as shown in FIG. 20, and an installation and removal position which permits the shank 210 to be installed and removed fore and aft of the upper side of the respective guide plates into and from the reciprocating space S, as shown in FIG. 21.

In the embodiment illustrated, a toggle clamp 270 is provided in order to carry out the opening and closing motion of the door 260, and it is so constructed that a manual operation can be carried out.

The toggle clamp 270 as illustrated has a latch block 271 which is fixed on the outer wall of the main body 201, a pivoting handle 273 which is axially supported on the latch block 271 by a pin 272, and a spring 274 which links the pivoting handle 273 with the door 260. The pivoting handle 273 is positioned along a slope formed at the front of the latch block 271, and the door 260 can be elastically locked in the blocking position. The pivoting handle 273 is pivoted about the pin 272 and is displaced to the position which intersects with the slope of the latch block 271. Therefore, the door 260 is designed to be displaced between the installation and removal positions by releasing the lock condition.

Although not specifically illustrated, an elastic member and a lock-releasing member 273, which is moved up and down by the elastic member, are provided on the pivoting handle 273. The locking condition (the condition shown in FIG. 20) can be maintained by hooking a hooking member, provided on the latch block 271, on the lock-releasing member 273*a*, and the lock-releasing member 273*a* is pushed in to release the hooking with the hooking member. Thus, the pivoting handle 273 is configured to be displaced to the releasing position (the condition of FIG. 21).

Figure 22:
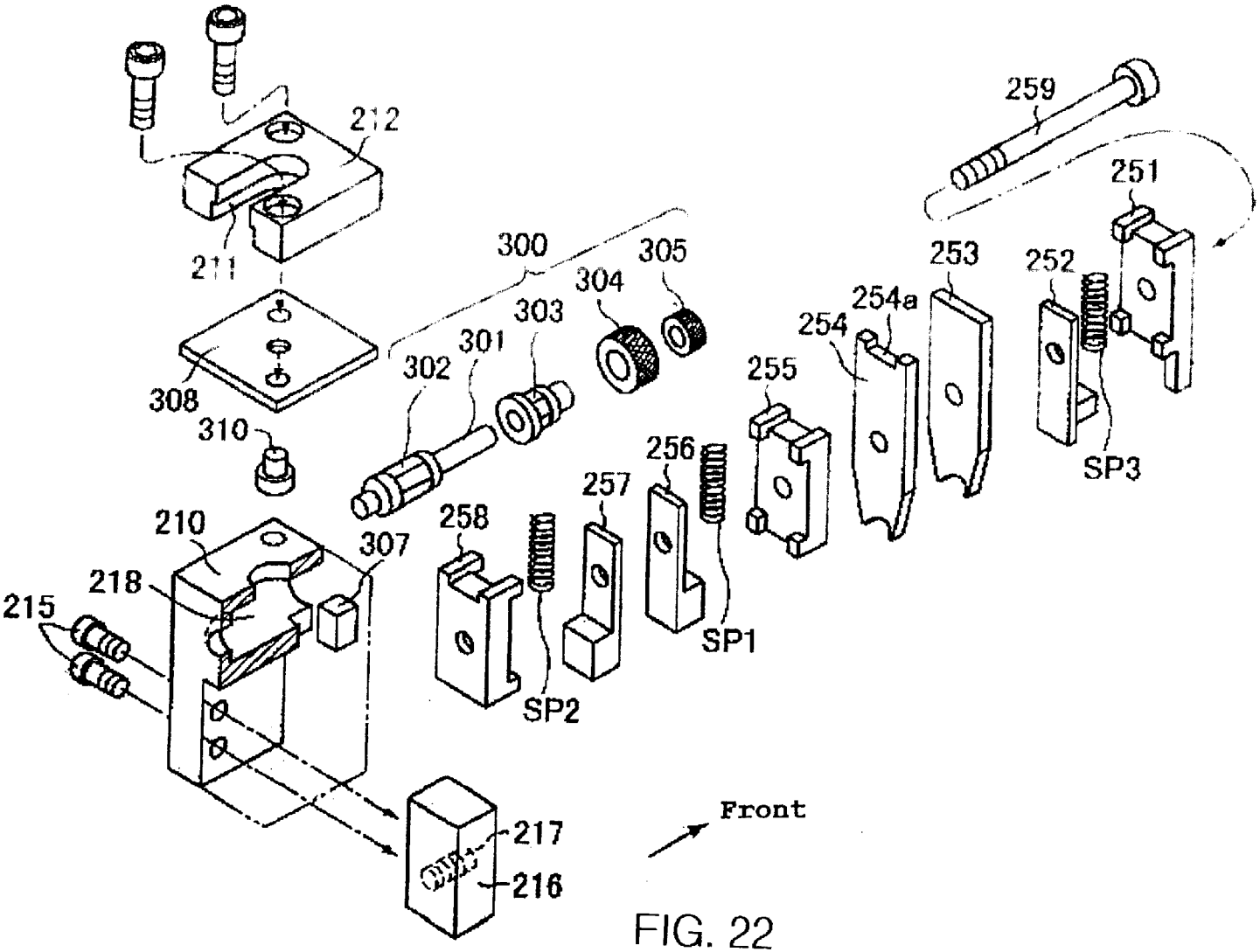
FIG. 22 is an exploded perspective view of the pressing unit related to the embodiment of FIG. 1.
Figure 23:
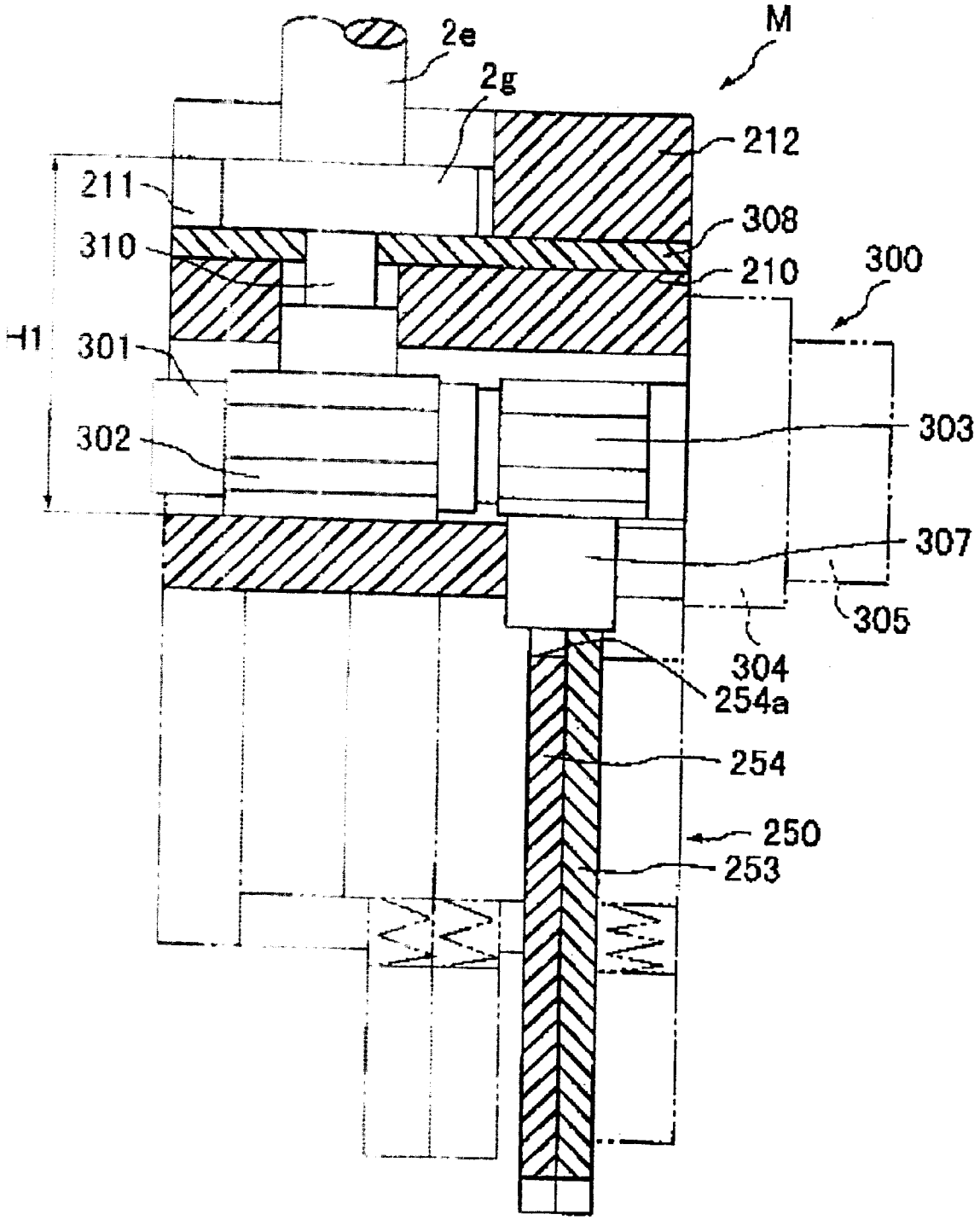
FIG. 23 is a schematic sectional view of the pressing unit related to the embodiment of FIG. 1.

Next, referring to FIG. 22 and FIG. 23, the crimper unit 250 that is assembled on the shank 210 is illustrated. FIG. 22 is an exploded perspective view of the pressing unit related to the embodiment of FIG. 1, and FIG. 23 is a schematic sectional view of the pressing unit related to the embodiment of FIG. 1.

Referring to these drawings, the crimper unit 250 related to the embodiment illustrated integrally constitutes the shank module M assembled with the shank 210.

In the example illustrated, the crimper unit 250 uses a cutting punch 251, an electric wire holder 252, an installation crimper 253, a wire crimper 254, a first polymer guide 255, a first reformer 256, a second reformer 257, and a second reformer guide 258 as a plurality of pressing members. The above-noted members are assembled in this order under the conditions where they can be integrally or relatively displaced, and are penetrated and linked together by the bolt 259. It should be noted that, although not necessarily illustrated in FIG. 22, sufficient clearance is provided between the aperture shown in each of members 251–258 and the outer diameter of the bolt 259 to enable each of the members to be individually relatively displaceable, as necessary. The bolt 259 links the respective members by being threaded into the screw hole 217 of the shank cover 216 which is fixed by bolts 215 at the innermost part of a housing 214 of the shank 210. The respective pressing members (251 to 258) are widely known. An electric wire is stopped and fixed by the electric wire holder 252 in cooperation with the respective members (the slide cutter 222, the insulation anvil 223, the wire anvil 224 and the spacer 225) of the anvil unit 220, the crimping terminals 6 of the terminal belt 5 are rectified by the reformers 256 and 256, the crimping terminals 6 are separated from the terminal belt 5 by the cutting punch 251, and the barrels 6*a* and 6*b* (Refer to FIG. 6) of the crimping terminals 6 are crimped by the crimpers 253 and 254. In the drawing, SP1, SP2 and SP3 are coil springs for elastically elevating the first reformer 256, the second reformer 257, and the electric wire holder 252, respectively.

Accordingly, a crimp height adjusting mechanism 300 is provided on the shank module M in order to adjust the crimp height according to the respective crimpers 253 and 254. The crimp height adjusting mechanism 300 is provided with a drive rod 301 arranged in an installation hole 218 formed in the shank 210, a height adjusting cam 302 is fixed on the rear end of the drive rod 301, an insulation cam 303 is concentrically arranged on the drive rod 301 more forwardly than the height adjusting cam 302 under conditions such that it can relatively rotate, an insulation dial 304 fixed on the front end part of the insulation cam 303, and a height adjusting dial 305 which is fixed on the front end part of the drive rod 301 at front of the insulation dial 304.

Furthermore, a height adjusting member 310 which moves up and down by being driven by the height adjusting cam 302 is provided on the shank 210, and a rectangular spacer 307 is provided between the insulation cam 303 and the insulation crimper 253. As widely known, the cross-sectional shapes of the respective cams 302 and 303 are formed in a polygonal shape which forms a cam face having different dimensions in the radial direction from the center of the drive rod 301, and the height in the up and down direction is designed to be changed between the cam face and the member contacting it by changing the cam face.

As shown in FIG. 23, the height adjusting cam 302 for adjusting the height of the wire crimper 254 rotates between the inner peripheral face of the installation hole 218 of the shank 210 and the lower face of the flange 2*g* of the reciprocating ram 2*e*, raises and lowers the height adjusting member 310 which is engaged with the cam 302, and changes the installation interval H1 between the shank 210 and the reciprocating ram 2*e*. As described above, the height adjusting cam 302 is fixed on the drive rod 301, and the height adjusting dial 305 is fixed on the front end of the drive rod 301. Therefore, the height adjustment can be carried out by rotating the height adjusting dial 305 in the assembled condition illustrated. Furthermore, in the example illustrated, a panel height adjusting holder 308 is provided between the shank 210 and the link 212. Separation from the shank 210 of the height adjusting axis 310 is designed by guiding the small diameter part of the height adjusting member 310 by the height adjusting holder 308, the disparity of the installation interval H1 is absorbed between the height adjusting holder 308 and the link 212, and the entire shank module M including the wire crimper 254 is designed to move up and down.

Furthermore, the insulation cam 303 for adjusting the height of the insulation crimper 253 is arranged on the upper side of both the crimpers 253 and 254 at assembly, and is linked with only the insulation crimper 253 through the spacer 307. The notch 254*a* is formed on the upper part of the wire crimper 254 in order to link with only the insulation crimper 253 (Refer to FIG. 22).

As described above, the insulation cam 303 is installed so that it can rotate relatively to the drive rod 301, and the insulation dial 304 is fixed on the front end of the insulation cam 303. Therefore, the height adjustment of the insulation crimper 253 can be carried out by rotating the insulation dial 304, in the assembly condition illustrated.

Thus, in the present embodiment, since the shank 210 is linked with the main body 201 and the reciprocating ram 2*e* of the press mechanism 200 under the condition such that it can be installed and removed, the shank 210 is separable from the main body part as elements constituting the shank module M together with the crimper unit 250, and a different shank 210 can be configured for each type of the crimping terminal 6 to be crimped such that they are exchangeable. As a result, the adjusting function of the crimp height (specifically, the crimp height adjusting mechanism 300) is determined by each shank 210, the integral installation and removal of the shank on the main body part together with the crimper unit 250 can be realized. Therefore, when the crimper unit 250 is configured for universal usability, adjustment after exchange of the crimper unit 250 is also as easy as possible.

Furthermore, in the embodiment described above, the crimper unit 250 has the insulation crimper 253 and the wire crimper 254, and when the shank 210 has the crimp height adjusting mechanism 300, it is possible to preliminarily set the adjustment of crimp height for every crimper unit 250, and it also becomes possible to more precisely adjust crimp height after exchange of the crimper unit 250.

Figure 24:
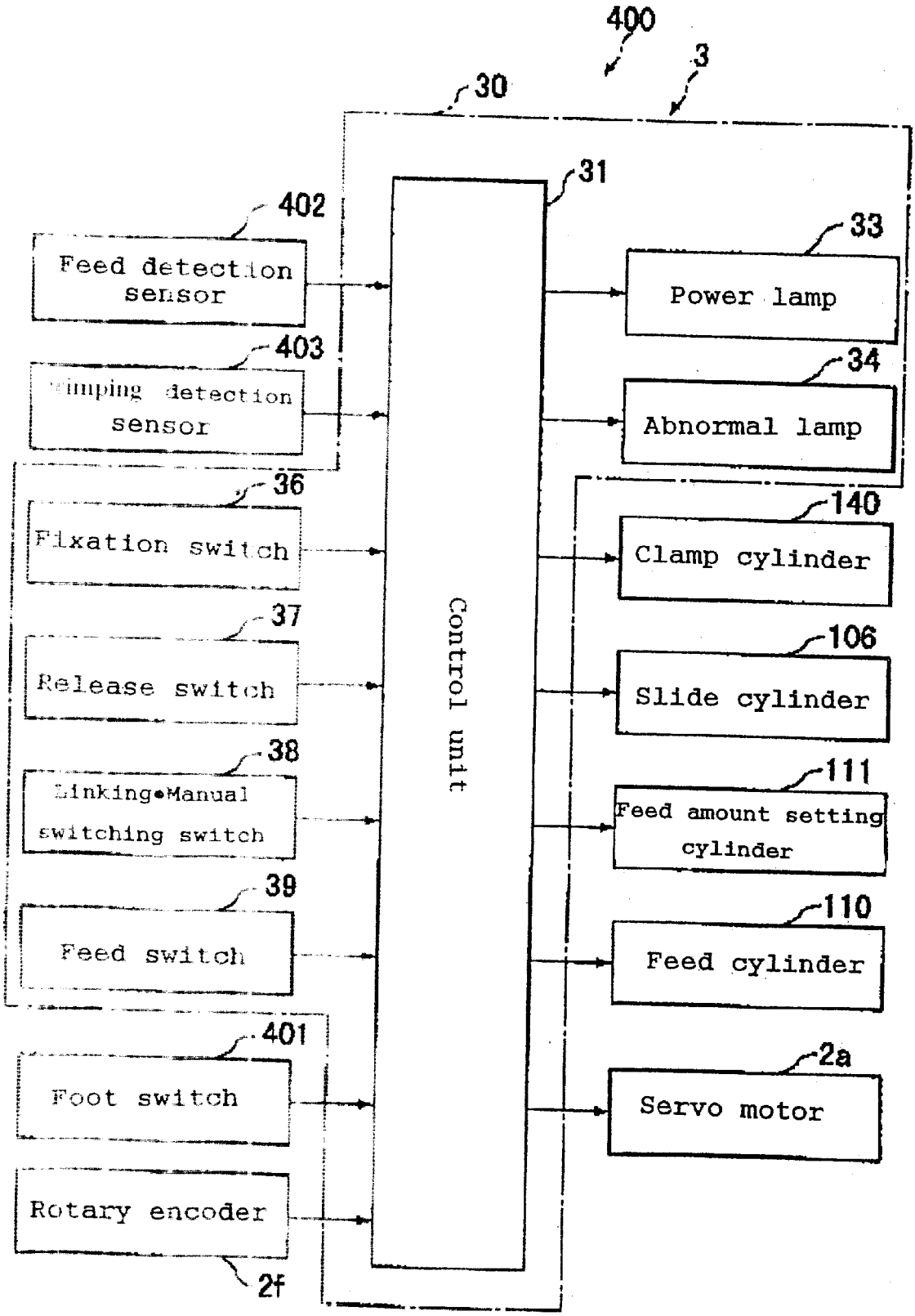
FIG. 24 is a block diagram of the terminal-crimping device related to the embodiment of FIG. 1.

Referring to FIG. 24, the link mechanism 400 (linking mechanism) for linking the terminal-feeding mechanism 100 with the press mechanism 200 is illustrated. In the present embodiment, the link mechanism 400 (Refer to FIG. 24) electrically controls by linking the terminal-feeding mechanism 100 with the press mechanism 200 according to the control of the control box 3 (Refer to FIG. 1).

Figure 25:
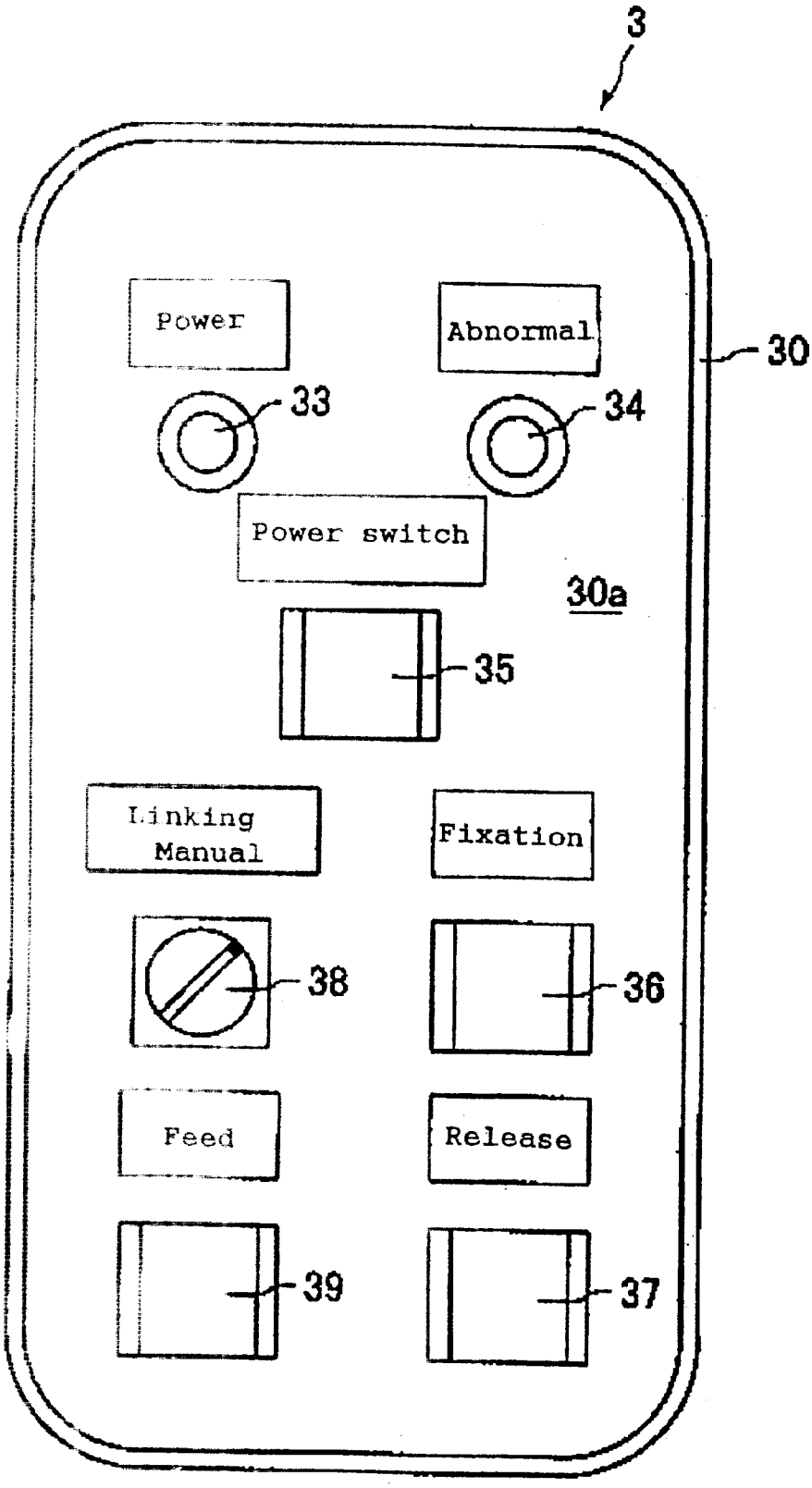
FIG. 25 is a front view of the control box of the terminal-crimping device related to the embodiment of FIG. 1.

FIG. 24 is a block diagram of the terminal-crimping device related to the embodiment of FIG. 1, and FIG. 25 is a front view of the control box of the terminal-crimping device related to the embodiment of FIG. 1. Furthermore, FIG. 26 is a schematic side view schematically showing the detection condition of the position detector provided at the press mechanism related to the embodiment of FIG. 1.

Referring to FIG. 1, and FIG. 24 and FIG. 25, the control box 3 which occupies the principal part of the link mechanism 400 is equipped with a box body 30 and a control unit 31(control) mounted in the box body 30. A display such as a power lamp 33, an abnormal condition indicator lamp 34 and the like, and a power switch 35 (abbreviated in FIG. 24), a fixation switch 36, a release switch 37, a continuous/manual switching switch 38, and a feed switch 39 are provided on the control unit 31. Furthermore, as external devices, a foot switch 401 for operating the terminal-crimping device by a worker is connected, and additionally, the servo motor 2*a* of the press device 1, the slide cylinder 106 of the terminal-feeding mechanism 100, a feed cylinder 110, and a feed amount setting cylinder 111 are connected. The servo motor 2*a* of the press device 1 and the respective cylinders 106,110, and 111 are designed to be operated by switching the foot switch 401 on, at a fixed timing to be described later.

Thus, a feed motion detection sensor 402 for detecting the relative change of the feed pawl block 102 is provided on the setting block 103 of the terminal-feeding mechanism 100 (refer to FIG. 2). The feed detection sensor 402 switches ON or OFF between a condition in which the feed pawl block 102 comes in contact with the prescription face 103*a* of the setting block 103 and a condition in which the feed pawl block 102 returns, separates from the prescription face 103*a* and moves to the down-stream side, and sends a signal to the control unit 31.

Figure 26:
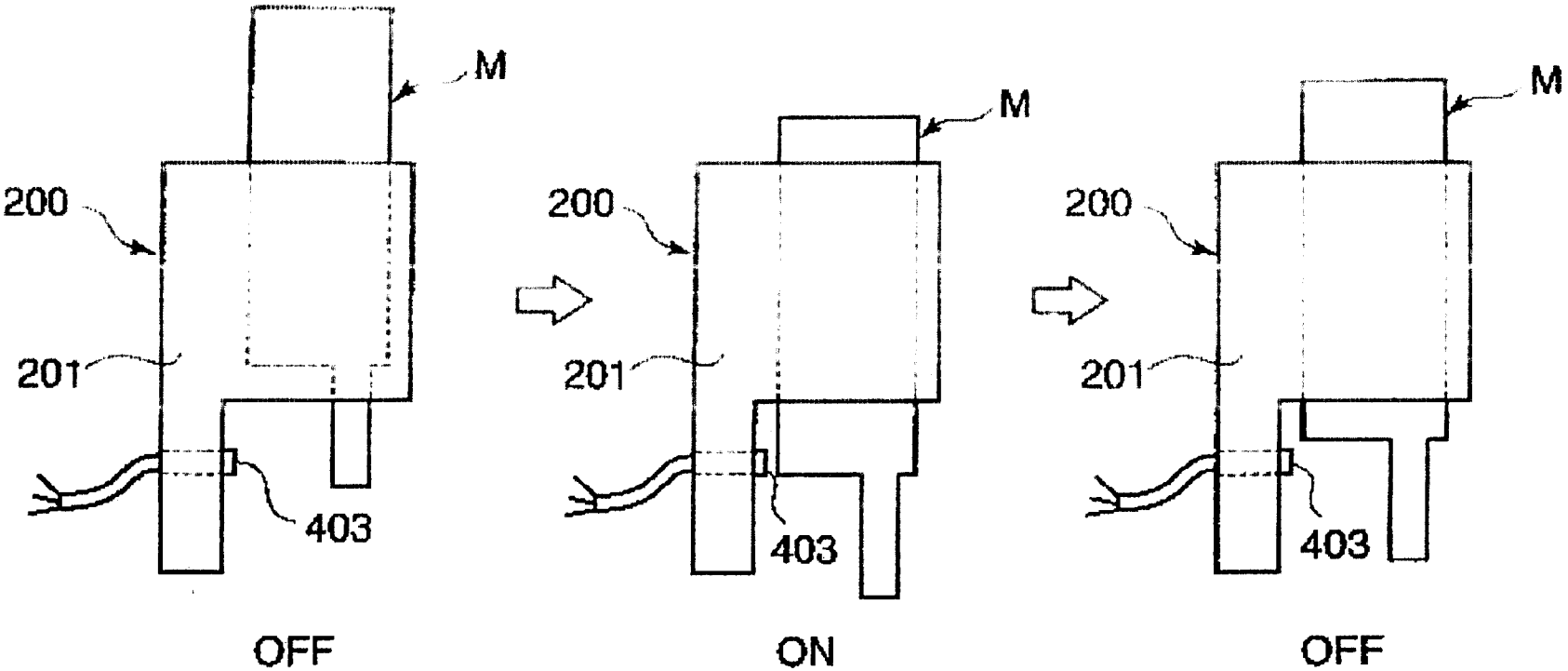
FIG. 26 is a schematic side view schematically showing the detection condition of the positional detector provided on the press mechanism related to the embodiment of FIG. 1.

Furthermore, referring to FIG. 26, a crimping detection sensor 403 is installed on the main body 201 of the press mechanism 200. The crimping detection sensor 403 is provided on the block body 201*a* of the main body 201. The sensor is configured so that it becomes OFF when the crimper unit 250 is situated at the upper fulcrum as shown in FIG. 26(A), it becomes ON when the crimper unit descends to the crimping position as shown in FIG. 26(B), while it becomes OFF when the crimper unit is elevated to a certain position from the crimping position of FIG. 26(B) to that shown in FIG. 26(C). The crimping motion of the shank module M is detected by the sequence, and the result detected is input to the above-mentioned control unit 31.

Figure 27:
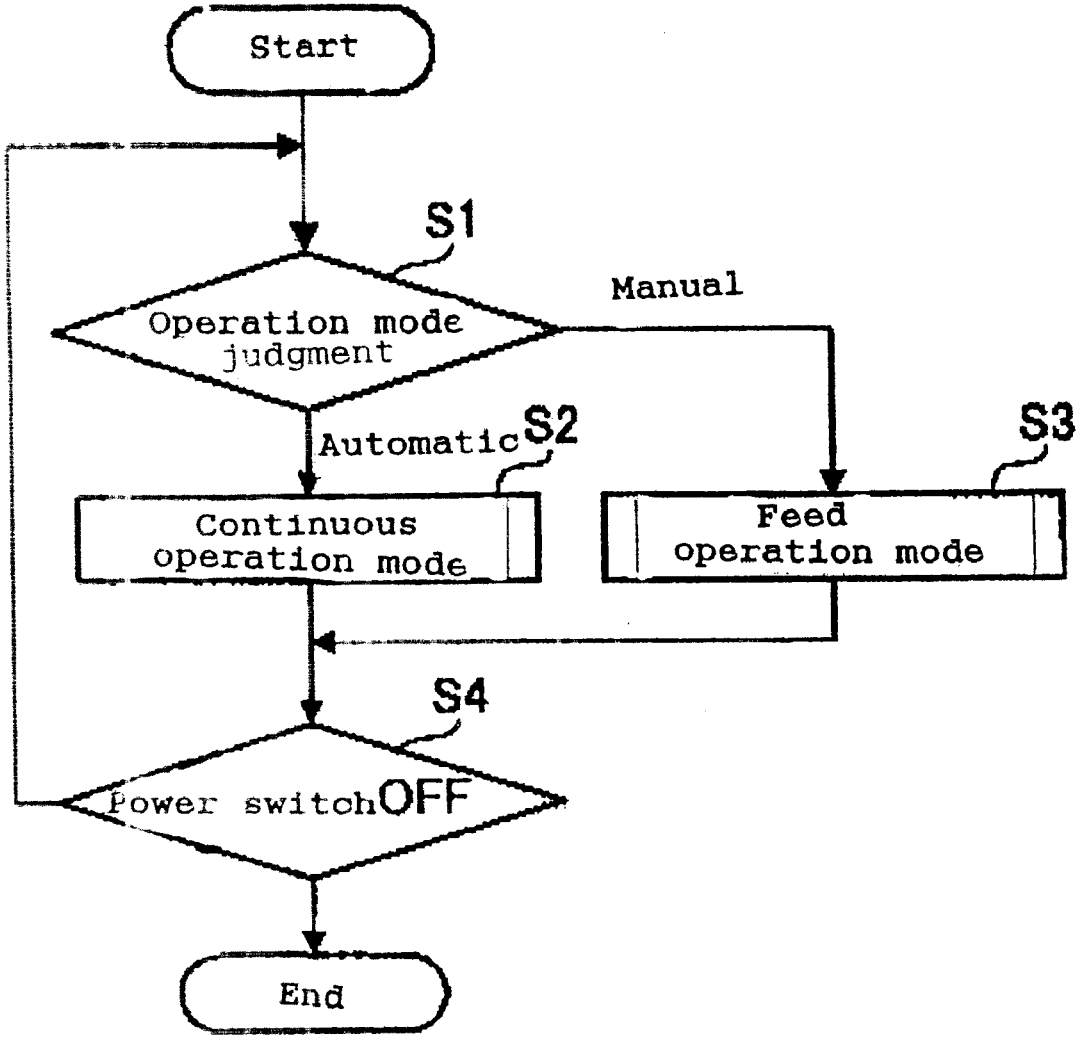
FIG. 27 is a flowchart showing the motion arrangement of the terminal-crimping device related to the embodiment of FIG. 1.
Figure 28:
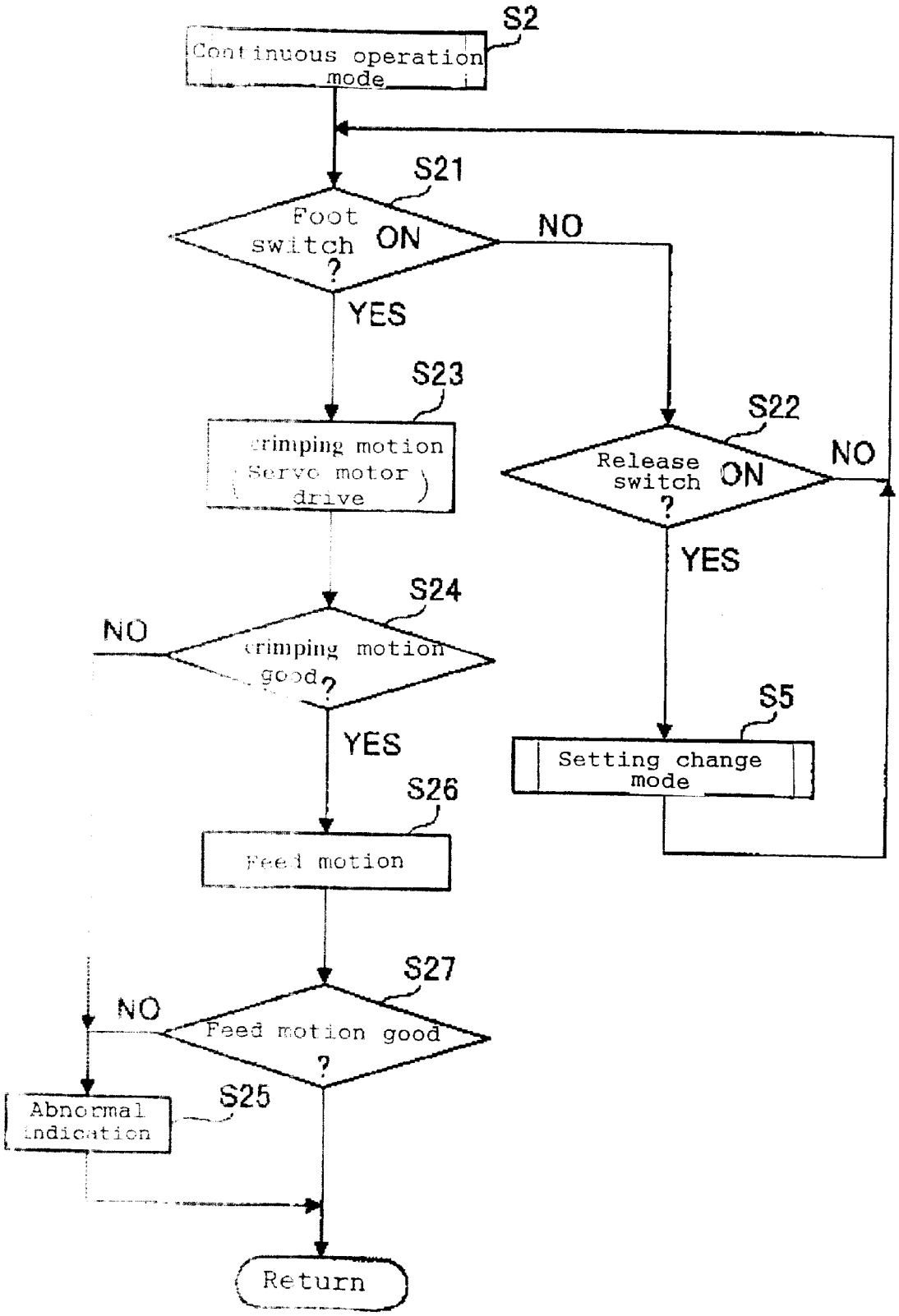
FIG. 28 is a flowchart showing the motion arrangement of the continuous operation mode in the motion arrangement of FIG. 27.
Figure 29:
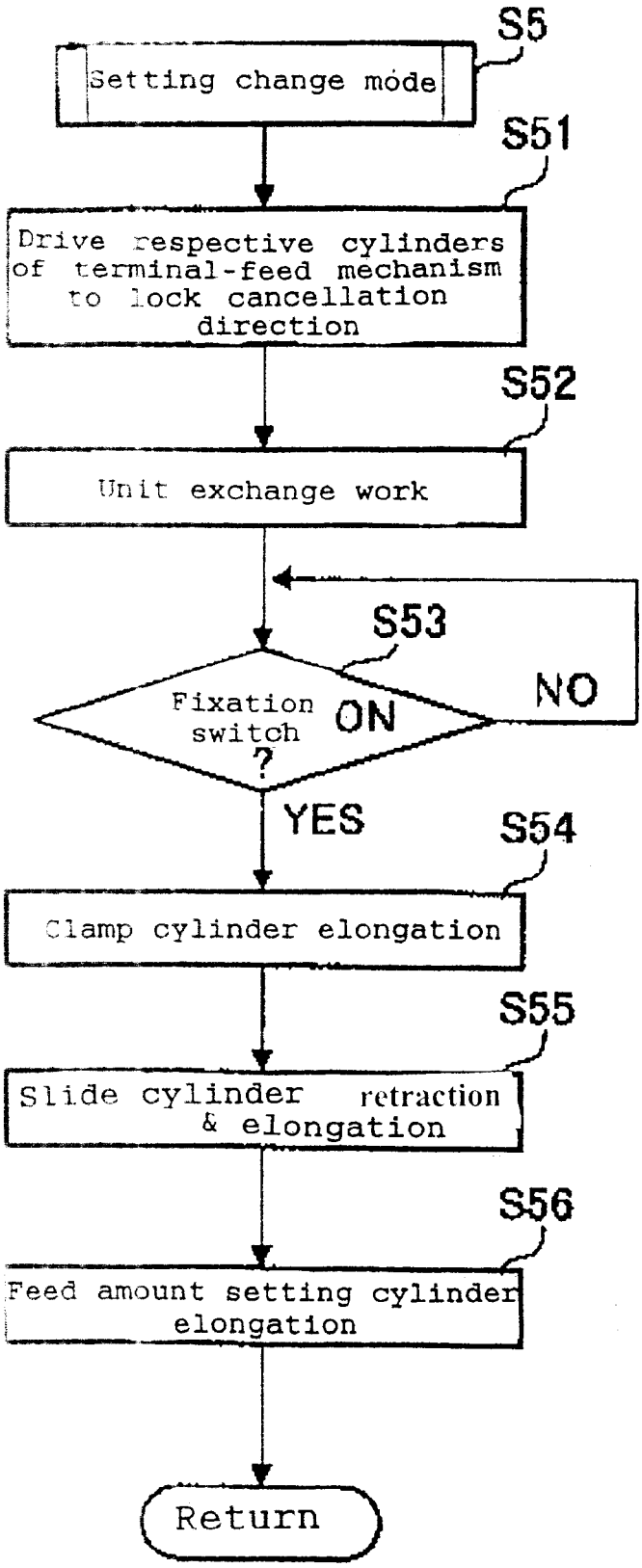
FIG. 29 is a flowchart showing the motion arrangement of the setting change mode in the motion arrangement of FIG. 28.

Then, referring to FIG. 27 to FIG. 29, the motion arrangement of the terminal-crimping device 10 is illustrated. FIG. 27 is a flow chart showing the motion arrangement of the terminal-crimping device related to the motion arrangement of FIG. 1, FIG. 28 is a flow chart showing the motion arrangement of the continuous operation mode in the motion arrangement of FIG. 27, and FIG. 29 is a flow chart showing the operations of the setting change mode in the motion arrangement of FIG. 28.

First, referring to FIG. 1 and FIG. 27, when the power switch 35 is operated to turn the power on, the control unit 31 checks the continuous/manual switching switch 38 in step 51, transfers to the "routine" (refer to step S2) of continuous operation mode when auto mode is selected, transfers to the "routine" (refer to step S3) of feed operation mode when manual mode is selected, and the above-mentioned steps are designed to repeat until the power turns OFF after returning from the respective subroutines (refer to step S4). In an initial condition, the terminal belt 5 is positioned to be fed to the terminal-feeding mechanism 100, and the end of the crimping terminals 6 is positioned to be fed to the anvil unit 220.

Referring to FIG. 1 and FIG. 28, when the control unit transfers to the "routine" of continuous operation mode, the control unit 31 first waits until the foot switch 401 is operated (Refer to step S21), and judges whether the release switch 37 is operated or not while the foot switch 401 is not operated (refer to the step S22). Then, when the release switch 37 is operated at this stage, the setting change mode S5, to be described later, is selected, and the respective parts of the terminal-crimping device 10 can be changed.

On the other hand, in the step S21, when a worker sets the end of a coated electric wire W (in which a stripping process was preliminarily carried out) on the crimping terminals 6 which were positioned on the press mechanism 200 and operates the foot switch 401, the control unit 31 drives the servo motor 2*a* of the press device 1, which causes the shank module M to descend, and raises it after crimping (refer to step S23). Therefore, the crimping detection sensor 403 detects the up and down motion of the shank module M in the manner shown in FIG. 26(A) to FIG. 26(C). The control unit 31 judges the quality of the crimping motion (refer to step S24) by the detection operation, and stops carrying out the operation if it judged as abnormal (refer to step S25). On the other hand, when it judged as good, the control unit 31 causes the feed cylinder 110 to extend, which drives the terminal belt 5 and feeds the successive crimping terminals 6 to the anvil unit 220. The feed motion is judged by the ON/OFF motion of the feed detection sensor 402, returns to the original routine when the feed motion is good, and stops carrying out the operation at the step S25 when it judged as abnormal.

Then, referring to FIG. 29, when the setting change mode of the step S5 is selected, the control unit 31 first drives the cylinders 106, 110, 111 and 130 of the terminal-feeding mechanism 100 in a cancellation direction, altogether. Thus, the anvil unit 220 of the press mechanism 200 is positioned to be able to be exchanged, and other moving elements (the unit base 101, the setting block 103, the upper guide 120) are together positioned to enable the exchange. Under this condition, a worker carries out the exchange of the respective units (specifically, the shank module M and the anvil unit 220) of the press mechanism 200 (Refer to step S52).

During the exchange, when a member of the pressing side is exchanged, the pivoting handle 273 is operated in the manner illustrated in FIG. 20 and FIG. 21, and the crimper unit 250 can be exchanged by opening the door 260 which is mounted on the main body 201 of the press device 1.

Furthermore, when the member receiving side is exchanged, the corresponding anvils 223 and 244 for the terminals can be changed only by exchanging the anvil unit 220, which is formed as a module.

The control unit 31 waits until the worker operates the fixation switch 36 on the control box 3 (Refer to the step S53). Then, when the fixation switch 36 is operated, the control unit 31 first causes the clamp cylinder 140 to extend, and presses the anvil holder 230 on the base 11 by the slide block 123 (refer to the step S54). Thereby, the anvil unit 220 is sandwiched between the slide block 123 and the base 11, and is firmly fixed (Refer to FIG. 15(A),(B)). Furthermore, as described above in FIG. 11, the guide height LA (L1 and L2 in FIG. 11) corresponding to the crimping terminals 6 can be automatically set by this construction.

Next, the control unit 31 positions the unit base 101 in contact with the anvil holder 230 of the anvil unit 220 clamped, by retracting and extending the feed cylinder 110 (refer to the step S55). Thus, as illustrated, all of the members supported by the unit base 101 move rearwardly and are positioned, and as shown in FIG. 12, the setting of the optimum distance LB (L3 and L4 in FIG. 12) to the corresponding terminal belt 5 can be carried out.

Finally, as shown in FIG. 19(A) and 19(B), the control unit 31 causes the feed amount setting device 111 to elongate, which brings the setting block 103 into contact with the adjusting bolt 234 of the corresponding anvil holder 230 (refer to the step S56). Thus, the confronting interval between the prescription face 103*a* of the setting block 103 and the adjusting bolt 233 corresponding to the feed pawl block 102 is automatically set, and the feed pawl block 102 moves back and forth within the confronting interval (refer to FIG. 19(C)). Therefore, as shown in FIG. 12, the setting of the optimum crimping interval (namely, a feed pitch) LC (L5 and L6 in FIG. 12) to the corresponding terminal belt 5 can be carried out.

When the extension of the feed amount setting device 111 is terminated, the control unit 31 returns to the routine of FIG. 27. Furthermore, when the feed operation mode (the step S3) is selected in FIG. 27, the feed cylinder 110 is configured to advance and return by one cycle by operating the feed switch 39. In this manner, a worker can carry out the initial setting of the terminal-crimping device, the check of feed amount, and the like.

As described above, in the present embodiment, when the feed condition of the terminal belt 5 is changed, the changing principal part of the terminal-feeding mechanism 100 can be automatically changed according to the positioning device (the anvil holder 230) provided on the press mechanism 200, by changing the position (specifically, the anvil unit 220) of the press mechanism 200. Therefore, when the press condition of the press mechanism 200 is changed, the adjustment of the terminal-feeding mechanism 100 becomes remarkably easy, and an outstanding result in the improvement of workability is made possible.

In the particular embodiment illustrated, since the clamp cylinder 140 is adopted and the clamp cylinder 140 constitutes the first drive member which concurrently holds a clamping mechanism for clamping the exchanged press mechanism (specifically, the anvil unit 220), the installation and removal processes of the anvil unit 220 and the reciprocating drive of the upper guide 120 can be simultaneously carried out with a single clamp cylinder 140 (for example, air cylinder), and a rapid setting change can be carried out by further simple construction.

Furthermore, the drive mechanism related to the present embodiment includes the air cylinders (110, 111, 106) as the successive drive members that sequentially drive other moving elements (the unit base 101 and the blocks 102 and 103) against the anvil holder 230 which the clamp cylinder 140 clamps. Accordingly, when the positioning of the anvil unit 220 is carried out by the clamp cylinder 140 as the first drive member, the positioning of the remaining moving elements (the unit base 101 and the blocks 102, 103) can be designed in connection with the anvil unit 220 which is positioned by the clamp cylinder 140. Therefore, a precise positioning can be positively carried out even if a plurality of moving elements exist.

Furthermore, in the above-mentioned embodiment, since the shank 210 is linked with the main body 201 and the reciprocating ram 2*e* such that it can be installed and removed, the shank module M is formed by the shank 210 together with the crimper unit 250 as a pressing unit, the shank module M is separable from the main body 201, and an exchangeable construction by every type of crimping terminals 6 becomes possible.

As a result, the adjusting function (the crimp height adjustment function 300) of the crimp height 250 is established by each shank 210, and the integral installation and removal of the crimper unit 250 to and from the main body 201 become possible. Therefore, the adjustment after exchange of the crimper unit 250 becomes as easy as possible when the crimper unit 250 is designed for universal usability.

In particular, since the shank 210 (or the shank module M) has the crimp height adjusting function 300, the adjustment of the crimp height can be preliminarily made for every crimper unit 250, and it is also possible to further precisely adjust the crimp height after exchange of the crimper unit 250.

Furthermore, in the present embodiment, since the linking mechanism 400 for linking the reciprocating motion of the shank 250 with the terminal-feeding mechanism 100 is provided, the linking of both is accomplished by an electrical control when the reciprocating motion of the shank 250 is linked with the terminal-feeding motion by the terminal-feeding mechanism 100 and the shape of the shank 210 is made more simple; thereby making it possible to accelerate the production of modules.

Furthermore, in the above-mentioned embodiment, since the door 260 (the opening and closing member) is provided on the main body 201, and the opening and closing motions of the door 260 are designed to be carried out by the toggle clamp 270 as the operating member, the installation and removal of the shank module M and the exchange work can be carried out without using any tools.

The above-mentioned embodiments exemplify only specific preferable examples of the present invention, and the present invention is not limited to above-mentioned embodiments.

Figure 30:
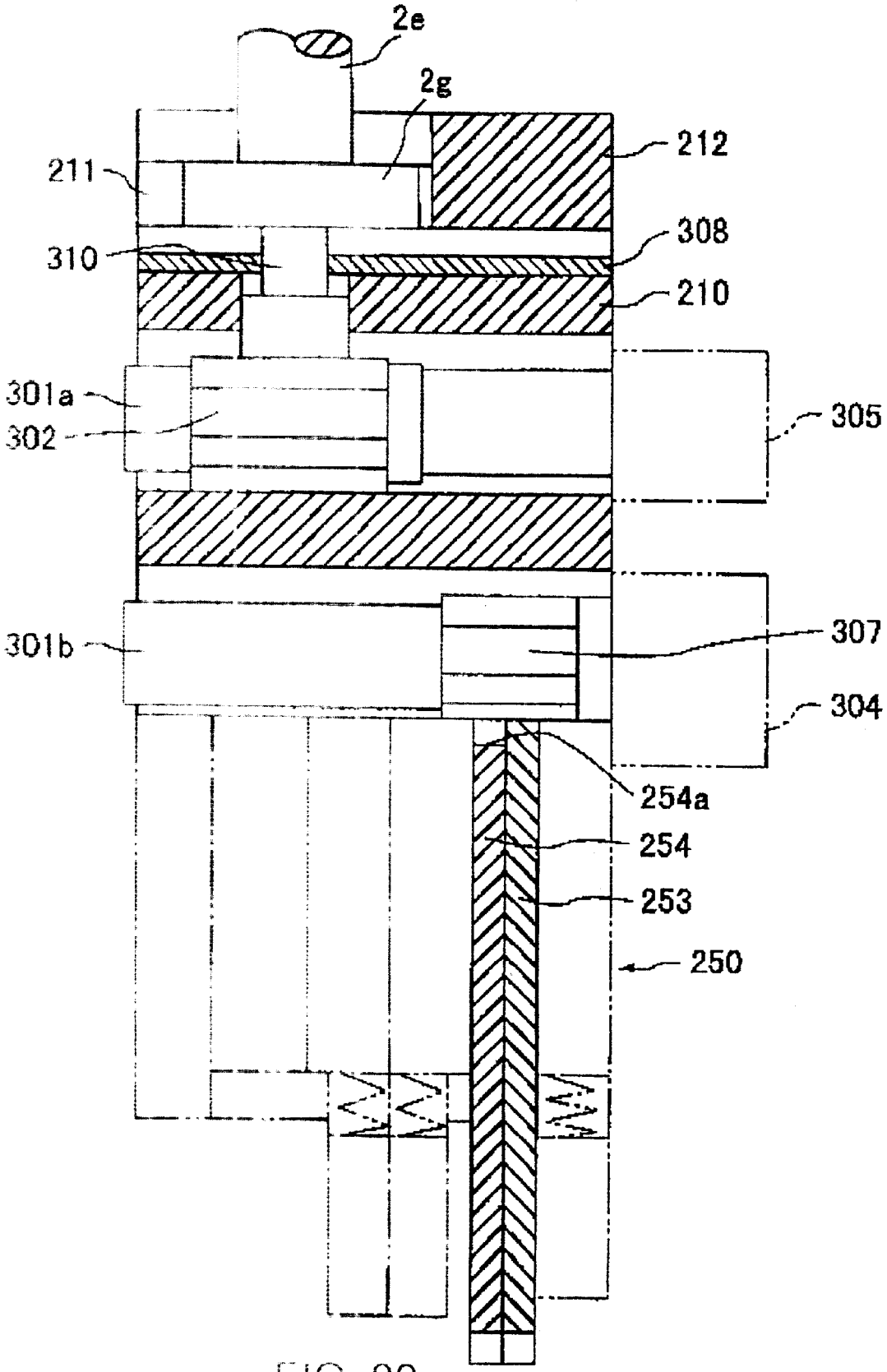
FIG. 30 is a schematic sectional view of the module related to another embodiment of the present invention.

For example, a modified example shown in FIG. 30 can be adopted. FIG. 30 is a schematic sectional view of the module related to another embodiment of the present invention.

As shown in FIG. 30, a device having two drive rods 301*a* and 301*b* at upper and lower positions may be adopted as the crimp height adjustment function 300 which is utilized for the crimper unit 250 as the pressing unit. In that case, the height adjusting mechanism of the wire crimper 254 (a mechanism for relatively changing the entire pressing unit 250 against the reciprocating ram 2*e*., i.e., the height adjusting cam 302, the height adjusting dial 305, and the height adjusting member 310) are grouped on the drive rod 301*a* at the upper position, and the height adjusting mechanism of the insulation crimper 253 (a mechanism for relatively changing only the insulation crimper 253 against the pressing unit 250, i.e., the insulation cam 307 and the insulation dial 304) is grouped on the drive rod 301*b* of the lower position. Furthermore, when this construction is adopted, the spacer 307 illustrated in FIG. 22 and FIG. 23 can be eliminated.

Figure 31:
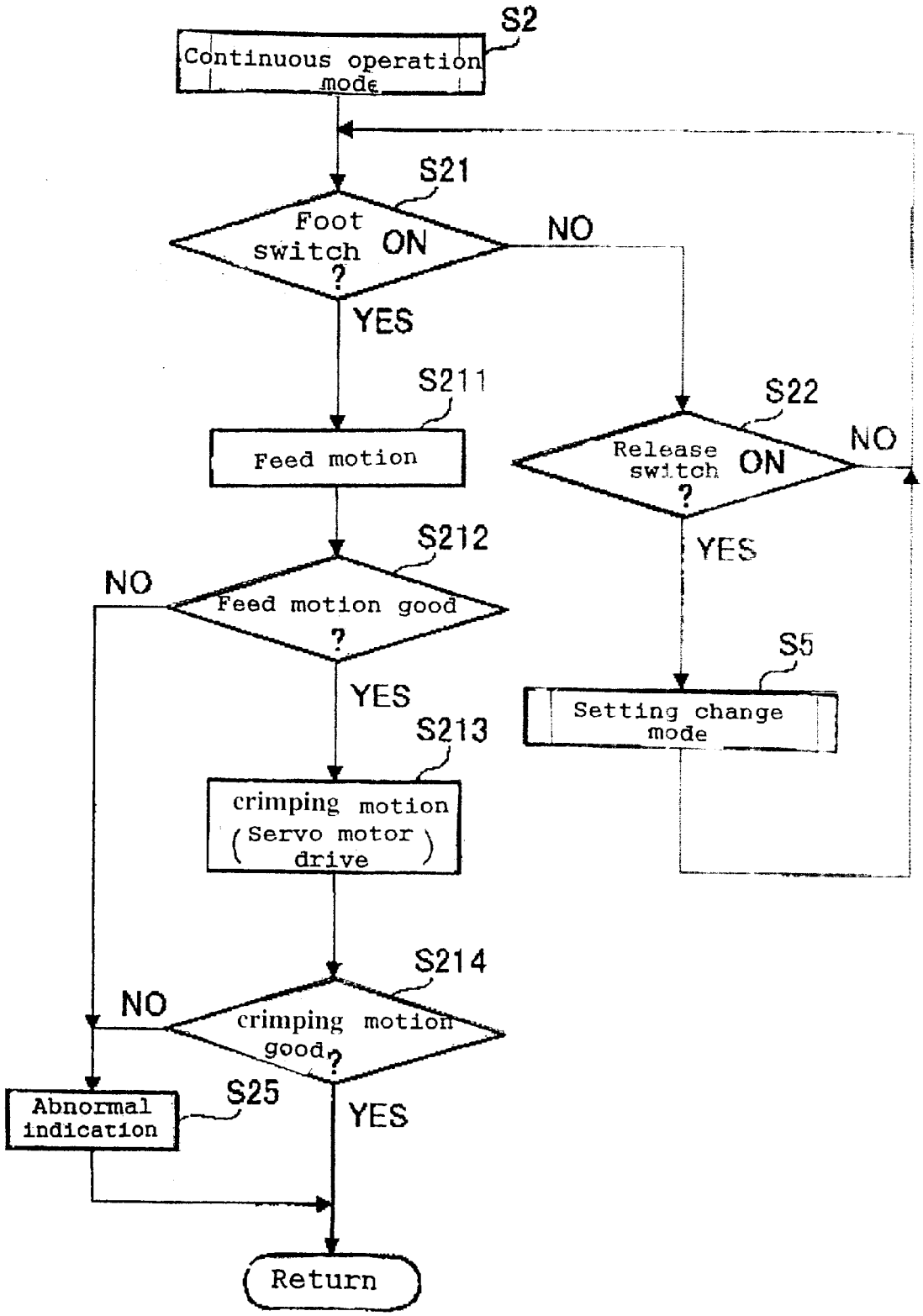
FIG. 31 is a flowchart showing the motion arrangement of the continuous operation mode related to the embodiment of FIG. 30.

Furthermore, the operational control during crimping can also adopt the motion arrangement shown in FIG. 31. FIG. 31 is a flowchart showing the motion arrangement of the continuous operation mode related to another embodiment of the present invention. As shown in the steps S211 to S214 of FIG. 31, as the clamping arrangement, the feeding motion of the terminal belt is first carried out and then the clamping motion may be carried out. The operational motion can be changed appropriately by the specification of a sensor and the like which are provided in the linking mechanism 400.

Furthermore, it goes without saying that various changes may be possible within the scope of claims of the present invention.

As described above, according to an aspect of the present invention, a shank is separable from a main body part as an element of the module of a pressing unit, sets a crimp height adjusting function is set for each shank, and the shank can be integrally installed on and removed from the main body part together with the pressing unit. Therefore, when the pressing unit is designed for universal usability, the remarkable effect that a setting work after exchange of the pressing unit can be easily, rapidly and precisely carried out is made possible.

Furthermore, as described above, according to another aspect of the present invention, when the feed condition of the terminal belt is changed, the principal part of the terminal-feeding mechanism can be automatically changed according to the positioning device provided on the press mechanism by changing the setting. Therefore, when the press condition of the press mechanism is changed, the adjustment of the terminal-feeding mechanism becomes remarkably easy, and an outstanding effect of the improvement in workability can be assured.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presented stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present application claims priority under 35 U.S.C. §119 of JP 2000-108620 and JP 2000-108621, both filed on Apr. 10, 2000, the disclosures of which are expressly incorporated by reference herein in their entireties.

What is claimed is:

1. A terminal-crimping device comprising:

a press mechanism configured to crimp a terminal on a coated electric wire, said press mechanism including a ram;

a terminal-feeding mechanism that feeds a continuous terminal belt into said press mechanism so that a terminal connected to the continuous terminal belt is in a position to be crimped by said press mechanism;

a main body on which said press mechanism is operably mounted;

a shank mounted on said main body for reciprocable movement and drivingly connected with said ram;

a crimper unit driven by said shank; and a shank module including said shank and said crimper unit, said shank module configured to allow said shank and said crimper unit to be integrally exchangeable, said shank module being detachably connected to said main body and said ram;

wherein said crimper unit includes a wire crimper which crimps a wire barrel formed on the terminal, and an insulation crimper which crimps an insulation barrel, and wherein said shank includes a crimp height adjusting mechanism that permits adjustment by relatively displacing respective crimper heights relative to said ram.

2. A terminal-crimping device according to claim 1, further comprising:

a linking mechanism that links reciprocating motion of said press mechanism with a feeding motion of the terminal-feeding mechanism;

wherein said linking mechanism comprises:

a feeding motion detector that detects the feeding motion of said terminal-feeding mechanism;

a crimping motion detector that detects the crimping motion of said press mechanism; and a control that carries out motion control of said terminal-feeding mechanism and said press mechanism based on detection signals of said feeding motion detector and said crimping motion detector.

3. A terminal-crimping device according to claim 1, further comprising:

an opening and closing member mounted on said main body, said opening and closing member being movable between an installation and removal position capable of permitting installation and removal of said shank to and from a reciprocating space in which said shank is raised and lowered, and a blocking position that regulates the removal of said shank arranged in space; and an operator that operates the opening and closing motion of said opening and closing member.

4. A terminal-crimping device comprising:

a press mechanism configured to crimp a terminal on a coated electric wire;

a terminal-feeding mechanism that feeds a continuous terminal belt into said press mechanism so that a terminal connected to the continuous terminal belt is in a position to be crimped by said press mechanism; and a base that supports said press mechanism and said terminal-feeding mechanism;

said press mechanism configured to be exchangeable on said base in accordance with the type of terminals to be crimped; and said terminal-feeding mechanism including movable elements configured to allow adjustment of the feeding of the continuous terminal belt in accordance with the type of terminals to be crimped, said terminal-feeding mechanism including a driving mechanism that drives the movable elements, and a positioning mechanism for setting positions of the movable elements corresponding to the terminal belt provided on said press mechanism.

5. A terminal-crimping device according to claim 4, wherein said press mechanism includes an exchangeable anvil unit that receives a terminal, said exchangeable anvil unit being exchangeable in accordance with the terminal type and said positioning mechanism is provided on said anvil unit.

6. A terminal-crimping device according to claim 4, wherein said driving mechanism includes a first driving member provided with a crimping device that clamps said exchangeable press mechanism.

7. A terminal-crimping device according to claim 6, wherein said driving mechanism includes a second driving member that sequentially drives another moving element for a positioning device of the press mechanism which engages the first driving member.

* * * * *

UNITED STATES PATENT AND TRADEMARK OFFICE

CERTIFICATE OF CORRECTION

PATENT NO. : 6,530,257 B2
DATED : March 11, 2003
INVENTOR(S) : T. Ooji et al.

It is certified that error appears in the above-identified patent and that said Letters Patent is hereby corrected as shown below:

Title page,
Item [56], References Cited, FOREIGN PATENT DOCUMENTS,
"4946388" should be -- 4 - 46388 --.

Signed and Sealed this

Twenty-seventh Day of January, 2004

JON W. DUDAS
*Acting Director of the United States Patent and Trademark Office*